United States Patent [19]

Multner

[11] 4,339,128

[45] Jul. 13, 1982

[54] BOWLING BALL PATH INDICATOR WITH ROM BALL PATH SELECTOR

[75] Inventor: James H. Multner, Los Angeles, Calif.

[73] Assignee: AMF Incorporated, White Plains, N.Y.

[21] Appl. No.: 164,429

[22] Filed: Jun. 30, 1980

[51] Int. Cl.[3] ..... A63D 5/04

[52] U.S. Cl. ..... 273/54 D; 340/323 B

[58] Field of Search ..... 273/14, 37, 54 C, 54 D, 273/54 E, 54 R; 235/92 GA; 340/323 R, 323 B; 364/410, 411; 434/249

[56] References Cited

U.S. PATENT DOCUMENTS

| | | | |
|---|---|---|---|
| 3,212,779 | 10/1965 | Gruss et al. | 273/54 D |
| 3,223,416 | 12/1965 | Blewitt, Jr. | 273/54 D |
| 3,428,313 | 2/1969 | Southard | 273/54 D |
| 3,460,832 | 8/1969 | Blewitt, Jr. | 273/54 D |
| 3,841,633 | 10/1974 | Walsh et al. | 273/54 D |
| 4,131,948 | 12/1978 | Kaenel | 273/54 C X |
| 4,148,480 | 4/1979 | Smith-Vaniz | 273/54 C X |

*Primary Examiner*—Vance Y. Hum

*Attorney, Agent, or Firm*—David E. Dougherty; Lawrence Hager

[57] ABSTRACT

A sparemaker display for operation in conjunction with automatic pinspotters is provided in which control signals characteristic of particular standing pin combinations are stored in a read only memory and addressed to control a ball path display upon the occurrence of a corresponding standing pin combination on the machine table of the pinspotter. This control signal is outputted from the read only memory through a decoder/-demultiplexer to drive a corresponding group of indicator lamps in defined ball path display configurations.

16 Claims, 7 Drawing Figures

BOWLING BALL PATH INDICATOR WITH ROM BALL PATH SELECTOR

FIELD OF THE INVENTION

This invention relates to apparatus for automatic bowling pin spotting machines and more particularly to improved apparatus for selecting and indicating to a player the proper path along which a ball should be rolled in order for that player to knock down the maximum number of bowling pins.

BACKGROUND OF THE INVENTION

The present invention is an improvement in ball path indicating systems for bowling pin spotting machines of the type disclosed in U.S. Pat. No. 3,212,779 to Gruss et al of Oct. 19, 1965, for (1) selectively actuated ball path indicating system, U.S. Pat. No. 3,223,416 to Blewitt, Jr., Dec. 14, 1965, and U.S. Pat. No. 3,460,832 to Blewitt, Jr., of Aug. 12, 1969, for (2) bowling path indicator, and U.S. Pat. No. 3,841,633 to Walsh et al of Oct. 15, 1974, for (3) bowling ball path indicator. These patents are assigned to AMF Incorporated, the assignee of the present invention.

Such ball path indicating systems generally include for each pin spotting machine, means, operative prior to the rolling of the ball of a frame, for determining the number and arrangement of standing pins, which means is associated with means for computing and selecting the optimum point of entry into an array of standing pins which the next ball should take to achieve maximum scoring results. Further, for each pin spotting machine an indicator is provided, coupled to the computer which is actuated to indicate to the bowler the optimum points so selected by the computer. The bowler, by following the visual directions provided by the indicating system, rolls his ball accordingly and if his aim is true will known down the maximum number of standing pins each time.

The foregoing sophisticated but highly desirable ball path indication and automatic selection of the ball path for maximized scoring has heretofore required a central ball path computer for up to, for example, 50 individual pin spotter machines and that computer acts to calculate a multiplicity of ball paths for a bowler at any given pin spotter upon the receipt of a call signal and a standing pin information signal from that given pin spotter.

In the system of the Walsh et al patent, the most recent of those above noted, the computer is provided with a scan sequence selector for selecting, through a predetermined interrogation sequence, one of 19 possible ball paths resulting from the various permutations and combinations of standing pins remaining on a bowling alley after the rolling of the first ball. By scanning the 19 possible ball paths in a predetermined sequence, the optimum path will be resolved as the first path to be detected in the scanning sequence.

Further, in that scanning sequence selector invention of Walsh et al, standing pin information was brought into the sequence scan selector through 19 input lines to a diode logic matrix having 11 output lines and each of said output lines controlled a respecting one of 11 ball path indicator relays which in turn are respectively actuated to illuminate a particular ball path indicator on the face plate of the pin spotter. Thus, 11 ultimate ball paths are utilized since many ball paths have common characteristics despite the fact that at any given time after a first ball has been rolled, there are 1,023 possible conditions of standing pins remaining on the bowling alley.

As can be seen from the foregoing discussion of the prior art, the requirement for a centralized computer, scan sequence selector, and resultant wiring and interconnection and compatible signal exchange between the scan selector, central computer and all of the pin spotter units in an establishment is a complex and sophisticated system. Accordingly, there is a standing and long-felt need in the art to simplify the equipment providing the highly desirable automatic ball path indication function together with indications of remaining pins standing after the rolling of a first ball.

It is, therefore, an object of the present invention to provide a simplified ball path indicating system for automatic pin spotting machines which obviates the need for a scan sequence selector and central computer.

Another object of the present invention is to provide a new and novel ball path selector system for automatic pin spotting machines which is self-contained within the individual pin spotter and which requires no external control circuitry to effectuate the desired indication of ball path and standing pins.

These and other objects of the present invention will become more fully apparent with reference to the following specification and drawings which relate to a preferred embodiment of the invention.

SUMMARY OF THE INVENTION

Figure 1:
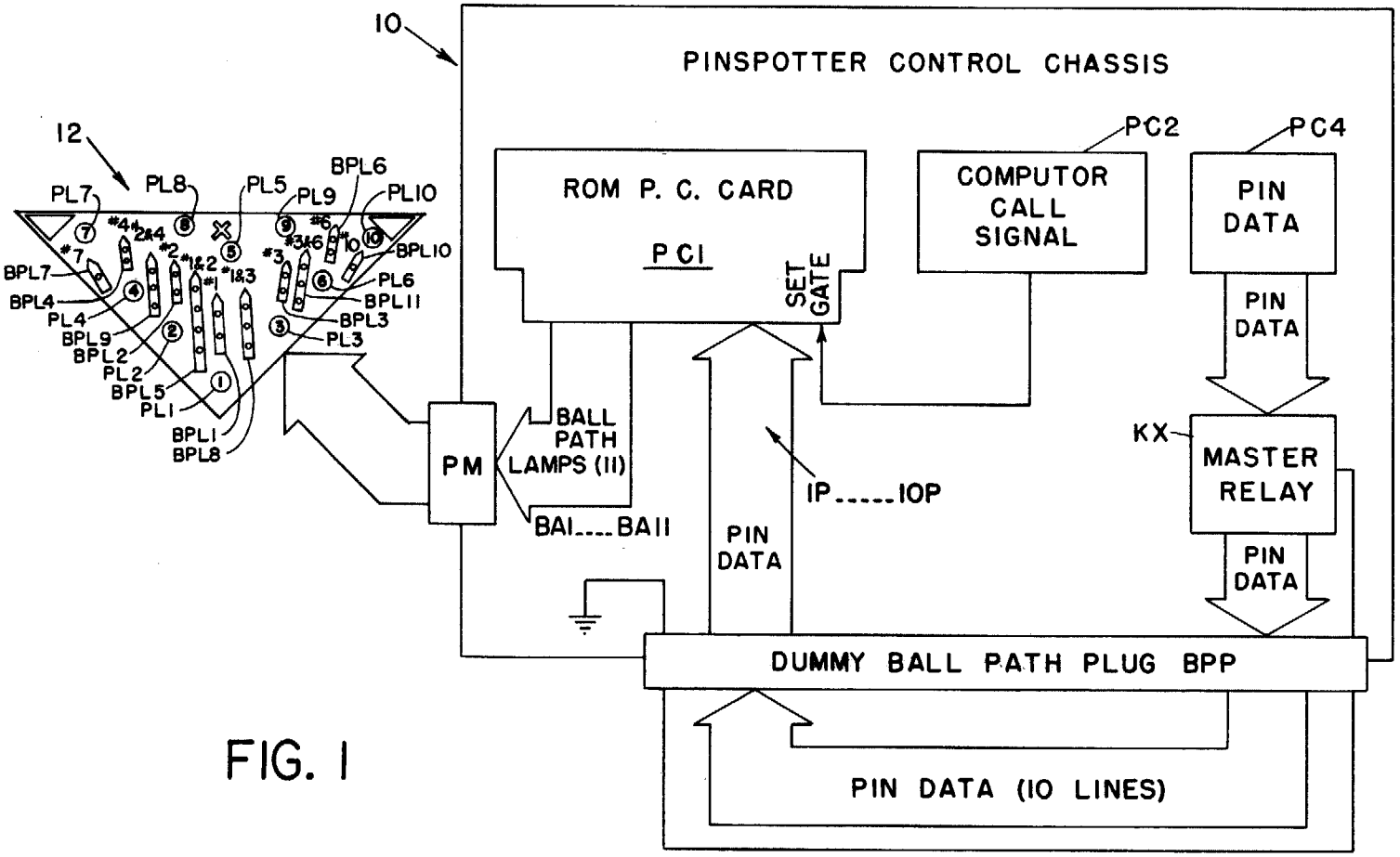
FIG. 1 is a schematic of the ball path and pin fall display mask and control circuitry therefor integrated with an automatic pin spotting control chassis.

The embodiment of the present invention illustrated herein is adaptable for use with known automatic pin spotting machines of the general type which spot and re-spot pins, remove bowling pins from the bowling alley deck, and which operate in accordance with the various ball cycles required by the rules of the American Bowling Congress.

In the bowling of a frame in a conventional ten-pin bowling game, there are 19 possible ball paths which can be rolled, identified by either a single pin or a multi-pin combination and these paths have sufficient overlapping characteristics resulting from the rolling of a ball there along such that the ultimate number of resolved optimum ball paths is reduced to 11.

There occurs in the game of bowling a total number of possible combinations of pins that may be left standing after the first ball is thrown. The total combinations that are possible is 1,024. This number includes all combinations from no pins (a strike) to a gutter ball (10 pins left standing). Further, each pin combination may have one out of 11 possible ball paths as previously discussed. The memory requirements, therefore, to properly manage such conditions must be such that each pin combination can be uniquely identified and contain the proper ball path information to achieve its removal from the pin deck or spot on the alley by a properly directed bowling ball following the uniquely identified ball path.

The above identified Walsh et al. patent is incorporated by reference herein and all of the other prior patents noted above which are also incorporated by reference to the extent required, provide the means to define the various pin combinations and the resulting ball paths so that what remains to be done by the present invention is to set up an addressing system and store the proper ball path at each address location which is characteristic of a particular pin combination. For this purpose, the present invention uses a read only memory, hereinafter referred to as the ROM. The ROM is a binary device having only two unique logic states, namely, one and zero, combined with which a weighted system of addressing and outputs is used to define the total number of combinations that occur. This weighted system is defined in the following table:

| ROM ADDRESSING (INPUTS) | | |
|---|---|---|
| PIN NUMBER | ADDRESS LINE | BINARY WEIGHT |
| 1 | $A_0$ | 1 |
| 2 | $A_1$ | 2 |
| 3 | $A_2$ | 4 |
| 4 | $A_3$ | 8 |
| 5 | $A_4$ | 16 |
| 6 | $A_5$ | 32 |
| 7 | $A_6$ | 64 |
| 8 | $A_7$ | 128 |
| 9 | $A_8$ | 256 |
| 10 | $A_9$ | 512 |
| TOTAL COMBINATIONS | | 1,023 |

The 1,024th combination is all zero inputs (a strike). Thus, only 1,023 address positions are required as a unique address in the ROM memory. The ROM address is formed by adding together the numerical weighted value of the standing pins. By way of example, the following table is illustrative:

| PINS STANDING | WEIGHTED VALUE | ADDRESS |
|---|---|---|
| 1, 2, 3, 7, 8, 9 | 1 + 2 + 4 + 64 + 128 + 256 | = 455 |
| 1, 3 | 1 + 4 | = 5 |
| 5, 7, 8 | 16 + 64 + 128 | = 208 |
| 4, 7, 6, 10 | 8 + 64 + 32 + 512 | = 616 |

The ROM outputs are four weighted data lines number $0_1$ (Least Significant Bit LSB) to $0_4$ (Most Significant Bit MSB). Actually, the total number of output combinations is $2^{(4)}=16$ of which only 11 are used consistent with the number of resolved ball paths which have been found in the art to properly define the desired optimum number of ball paths to be rolled in correlation with the various possibilities of standing pins remaining after a first ball has been thrown. The following table illustrates the ROM outputs correlated with the ball path arrows which include their path designations as suffixes, either as single pin suffixes or multi-pin suffixes illustrating the 11 optimum resolved ball paths known in the art. The ROM output codes which are not used are also included in the following table to preclude confusion in this regard:

| ROM OUTPUTS | | | | |
|---|---|---|---|---|
| MSB | | | LSB | |
| $0_4$ 8 | $0_3$ 4 | $0_2$ 2 | $0_1$ 1 | ASSIGNED BALL PATH |
| 0 | 0 | 0 | 0 | Not used (strike) |
| 0 | 0 | 0 | 1 | Arrow (1) |
| 0 | 0 | 1 | 0 | Arrow (2) |
| 0 | 0 | 1 | 1 | Arrow (3) |
| 0 | 1 | 0 | 0 | Arrow (4) |
| 0 | 1 | 0 | 1 | Arrow (1-2) |
| 0 | 1 | 1 | 0 | Arrow (6) |
| 0 | 1 | 1 | 1 | Arrow (7) |
| 1 | 0 | 0 | 0 | Arrow (1-3) |
| 1 | 0 | 0 | 1 | Arrow (2-4) |
| 1 | 0 | 1 | 0 | Arrow (10) |
| 1 | 0 | 1 | 1 | Arrow (3-6) |
| 1 | 1 | 0 | 0 | Not used |
| 1 | 1 | 0 | 1 | Not used |
| 1 | 1 | 1 | 0 | Not used |
| 1 | 1 | 1 | 1 | Not used |

After the pin data has been inputted to the ROM memory and the resulting logical outputs have been effectuated, a decode demultiplexer receives these signals and converts the binary output from the ROM into a unique output for every combination of inputs such that standing pin indicator lights and ball path indicating arrows are illuminated on the pin spotter mask unit.

DETAILED DESCRIPTION OF THE DRAWINGS

Referring to FIG. 1, the pin spotter control chassis 10 of the present invention is shown as including a ROM printed circuit card PC1, a computer call signal printed circuit card PC2, a pin data printed circuit card PC4, a KX or master relay means, a dummy ball path plug BPP interconnecting the pin data card PC4 through the master relay KX into the ROM inputs 1P . . . 10P to thereby place the standing pin information at the input side of the ROM memory in the ROM card PC1. The ROM card outputs BA1 . . . BA11 corresponding to the 11 ball path arrows in the mask unit 12 are connected through the output interconnection device PM to suitable interconnections with the ball path arrows as will be hereinafter more fully described in connection with FIG. 2B. The main interconnector means PM also includes connections for the No. 1 pin through the No. 10 pin indicator lamps on the mask 12 as will also be more fully described hereinafter with respect to FIG. 2B.

Figure 2A:
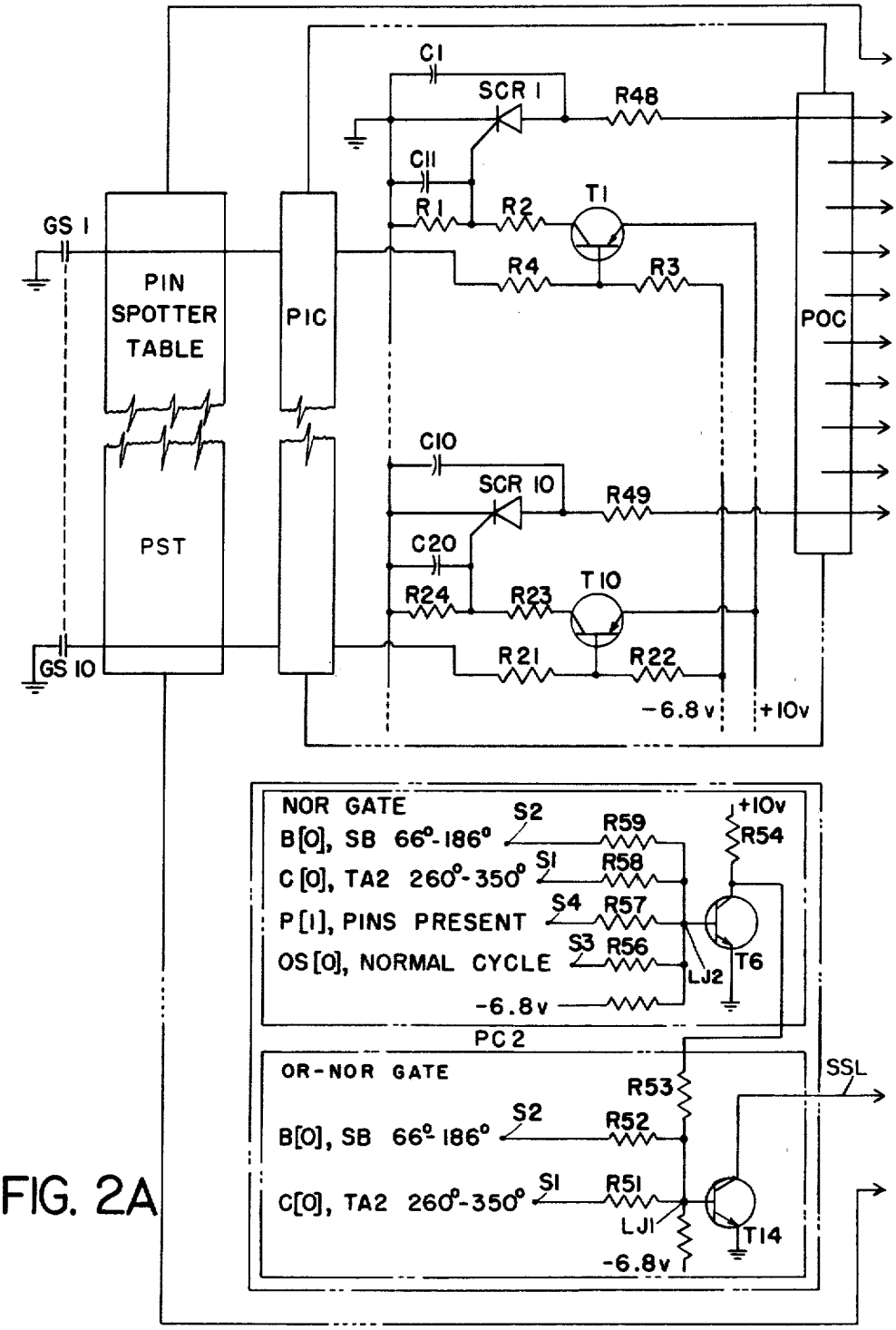
FIGS. 2A and 2B constitute a schematic of the ROM logic circuit of the present invention driven by the various information inputs required to calculate the ball paths to be displayed and the indication of standing pins.
Figure 2B:
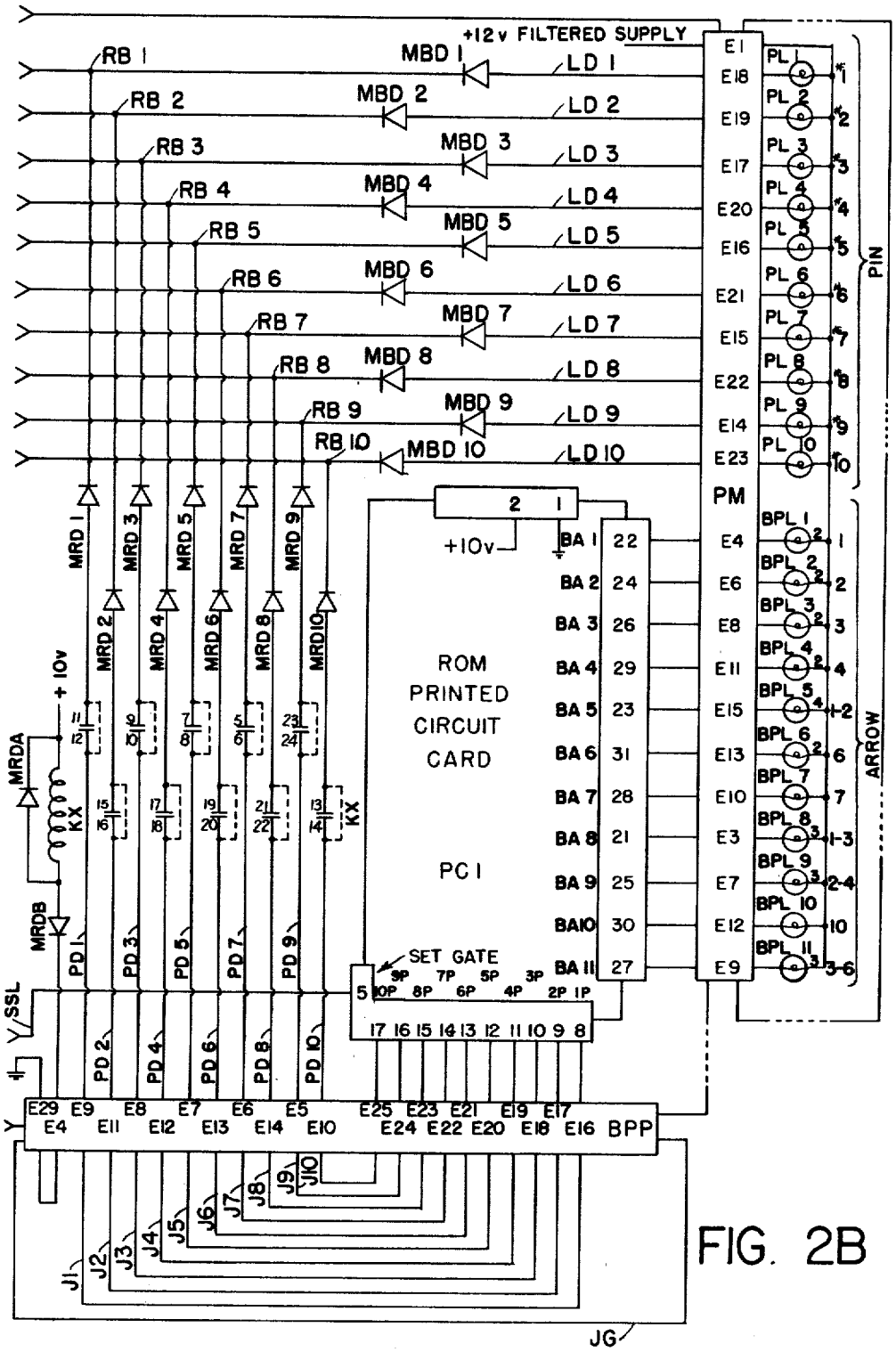

Referring now to FIGS. 2A and 2B, the ROM printed circuit card PC1 is shown as including terminal pins 8 through 17 corresponding, respectively, to the No. 1 pin 1P through the No. 10 pin 10P, the designations 1P through 10P comprising the inputs for the pin data derived from the gripper switches GS1 through GS10 schematically illustrated in FIG. 2A.

The dummy ball path plug BPP includes ten connections E16 through E25 which correspond, respectively, to input terminal pin connections 8 through 17 and inputs 1P . . . 10P of the ROM printed circuit card PC1.

The master relay KX is constantly engaged through a terminal pin E4 on the ball path plug BPP assembly which connects to ground through another terminal pin E29 on the ball path plug assembly BPP. The pin E4 is connected to the cathode side of an isolating diode MRDB in series with the winding of the relay KX, the latter being connected at its opposite end to a plus 10 volt source. A shunt diode MRDA is connected in the reverse direction across the winding of the relay KX as is well known in the art.

As further illustrated in FIG. 2B, a plurality of pin data lines PD1 . . . PD10, corresponding, respectively, to the first through the tenth pins and the gripper switches GS1 . . . GS10, are correlated with terminal pins E9, E11, E8, E12, E7, E13, E6, E14, E5 and E10 which are respectively shunted by jumpers J1 through J10 to the terminal pins E16 through E25 on the previously described half of the dummy ball bath plug assembly BPP. A common ground connection between the terminal pins E27 and E29 on the ball path plug assembly BPP in indicated as a jumper JG.

Therefore, to summarize, the ball path plug assembly BPP interconnects the pin data lines PD1 through PD10 to the ROM card inputs 1P through 10P, respectively.

The pin data lines PD1 . . . PD10 are connected through pairs of relay contacts of the master relay means KX, where the relay KX is included in a given automatic pin setting machine or through direct lines to common sensing terminals RB1 . . . RB10 through respective coupling diodes MRD1 . . . MRD10 connected in the forward direction from the ball path plug pins to the said common sensing junctions RB1 . . . RB10.

Where master relay means KX is included in a given pin spotter chassis, contact numbers 11 and 12 are in the line PD1, contact numbers 15 and 16 are in the line PD2, contact numbers 9 and 10 are in the line PD3, contact numbers 17 and 18 are in the line PD4, contact numbers 7 and 8 are in the line PD5, contact numbers 19 and 20 are in the line PD6, contact numbers 5 and 6 are in the line PD7, contact numbers 21 and 22 are in the line PD8, contact numbers 23 and 24 are in the line PD9, and contact numbers 13 and 14 are in the line PD10.

The common logic sensing junctions RB1 . . . RB10 are located, respectively, in pin lamp data lines LD1 . . . LD10 on the cathode side of coupling diodes MBD-1 . . . MBD-10, the anode side of the said coupling diodes being connected through the said pin lamp data lines LD1 through LD10 to the pin lamps PL1 through PL10, respectively, corresponding to the number 1 through number 10 pins on the bowling alley associated with the pin spotter chassis.

The pin indicating lamps PL1 through PL10 are connected in common to a 12 volt filtered supply through a terminal pin E1 on the main interconnector PM and thence through respective terminal pins E18, E19, E17, E20, E16, E21, E15, E22, E14 and E23 to the pin lamp data lines LD1 through LD10, respectively.

The 12 volt filtered supply is also connected in common to the 11 ball path indicator lamps BPL1 through BPL11 which correspond, respectively, to the outputs BA1 through BA11 from the ROM printed circuit card PC1.

In this regard the main interconnector PM has the ball path lamps BPL1 through BPL11 connected respectively with connector pins E4, E6, E8, E11, E15, E13, E10, E3, E7, E12 and E9 together with output terminal pins 22, 24, 26, 29, 23, 31, 28, 21, 25, 30, and 27 of the ROM printed circuit card PC1.

The ROM printed circuit card PC1 also includes a ground pin 1 and a plus 10 volt pin No. 2.

Adjacent each ball path lamp BPL1 through BPL11 is a subscript which indicates the number of individual lamps connected in parallel to constitute a respective full arrow illumination for a ball path indication. For example, the ball path lamps BPL1 through BPL4 each consist of two lamps in parallel in a preferred embodiment, the fifth ball path lamp BPL5 has 4 bulbs, the sixth ball path lamp BPL6 has 2 bulbs, the eighth, ninth and eleventh ball path lamps BPL8, BPL9 and BPL11 have 3 bulbs each, and the seventh and tenth ball path lamps BPL7 and BPL10 have 1 bulb each. By correlating the subscripts adjacent each of the lamps BPL1 through BPL11 with the legend to the right of each of the lamps describing the pin number associated with each ball path arrow, it can be seen that the multiple pin ball path arrows such as the 1-2 arrow, the 1-3 arrow, the 2-4 arrow, and the 3-6 arrow require 4, 3, 3 and 3 bulbs, respectively. All of this is in keeping with the configuration of the ball path and pin fall display mask 12 illustrated in FIG. 1.

Referring now to FIG. 2A, the standing pin data provided to the ball path indicator of the present invention is derived from the ten gripper switches GS1 through GS10 on the pin spotter table PST which are connected, respectively, through a pin information coupler PIC or input terminal device PIC to a plurality of identical sensing circuits which will be described as typical with respect to the first and tenth gripper switches GS1 and GS10.

Referring to the gripper switch GS1, it can be seen that one side of the gripper switch is grounded while the other side is connected directly through a resistor R4 to the base terminal of a transistor T1 and thence through a resistor R3 to a suitable bias voltage, minus 6.8 volts. The emitter of the transistor T1 is connected to a plus 10 volt supply in common with all of the emitters of a plurality of transistors T1 through T10 associated, respectively, with the gripper switches GS1 through GS10. The collector of the transistor T1, which is a PNP transistor is connected through a resistor R2 and R1 to ground with the junction between the resistors R1 and R2 being grounded through a capacitor C11 and directly connected to the gate terminal of a first silicon control rectifier SCR1. The silicon control rectifier SCR1 has a capacitor C1 in shunt across its anode and cathode terminals with the cathode terminal of the silicon control rectifier SCR1 being grounded and the anode being connected through a resistor R48 and isolating diode MBD1 to the first pin lamp data line PLD1.

A common output connector POC is provided with a plurality of terminal pins thereon correlated to each of the pin lamp data lines LD1 through LD10 and the corresponding common sensing junctions RB1 through RB10 therein.

Similarly, for the gripper switch GS10 for the No. 10 pin, one side of the GS10 is grounded while the other side is connected directly through a resistance R21 to the base terminal of a PNP transistor T10 while the base is connected through a resistance R22 to the minus 6.8 volt supply. The emitter terminal of the transistor T10 is connected to the plus 10 volt supply while the collector is connected through a resistor R23 and R24 to ground. The junction between the resistors R23 and R24 is grounded through a capacitor C20 and connected directly to the gate terminal of a tenth silicon control rectifier SCR10 which is peculiar to the tenth pin on the alley associated with the pin spotter table PST and the gripper switches GS1 through GS10. The silicon control rectifier SCR10 has its cathode grounded, its anode shunted to ground through a capacitor C10 and its anode connected through a resistor R49 directly to the data line LD10 of the pin lamp PL10 as well as the common sensing junction RB10 therein. This connection is effectuated through the common output connector POC. Thus, similar SCR trigger circuits are provided for each gripper switch in the ten gripper switch array GS1 through GS10, respectively. Accordingly, when a gripper switch is closed, its respectively associated transistor is caused to conduct which causes a bias potential to be applied to the gate of the SCR associated therewith which fires and draws current from the plus 12 volt filtered supply through a particular data line LD1 through LD10 to illuminate a particular pin lamp PL1 through PL10 and maintain the SCR in its conducting condition until such time as external means are applied to extinguish the particular pin indicator lamp PL1 through PL10 (i.e., the filtering is removed from the plus 12 volt lamp supply extinguishing the pin lamps when the voltage goes to zero).

To complete the description of FIGS. 2A and 2B, a SET gate input terminal pin 5 is provided at the input terminals of the ROM printed circuit card PC1 which is connected by a set signal lead SSL to the collector of an NPN transistor T14 having a grounded emitter and having its base terminal connected to a logic input junction LJ1, the latter being connected to the minus 6.8 volt source through a resistor R50, through a resistor R51 to a first status input S1, and through a resistor R52 to a second status input S2, the status inputs S1 and S2 representing various conditions of the pin spotter being monitored as will be hereinafter more fully described. Further, the logic sensing junction LJ1 is connected through a resistor R53 to the collector of another NPN transistor T6 which collector is connected to the plus 10 volt supply through a resistor R54. The emitter of the transistor T6 is grounded and the base of the transistor T6 is connected to a second logic sensing junction LJ2 which is connected through a resistor R55 to the minus 6.8 volt supply, through resistor R56 to a third status input S3, through a resistor R57 to a fourth status input S4, through a resistor R58 to the first status input S1 and through a resistor R59 to the second status input S2.

Thus, the transistor T6 is connected in a NOR gate configuration with its various resistors and inputs and thence controls an or-not gate configuration comprising the transistor T14 and its various resistors and status inputs. These two gates act together to provide a set signal input broadly identified in FIG. 1 as the SET gate input of the printed circuit card PC1 and also identified as the SET gate input of the printed circuit card PC1 in FIG. 2B, with the SET gate signal being accomplished through the input terminal pin 5.

In sensing the input conditions of an associated pinspotter, the status inputs S1, S2, S3 and S4 are defined as follows, with logic values correlated to degrees of rotation of the pinspotter machine table for the first two status inputs S1 and S2, the presence of a normal/abnormal cycle for the third status input S3 and pins present for the fourth status input S4.

S1=0 For Pinspotter Machine Table Rotation 260°-350°

S2=0 For Pinspotter Machine Table Rotation 66°-186°

S3=0 For a normal cycle (e.g. absence of off-center pins no fouls or pinspotter machine table)

S4=1 For any pins present on the pinspotter machine table.

Under other than specified conditions, respective inverse logic values prevail for S1, S2, S3 and S4.

Referring now to FIGS. 3A, 3B, 3C and 3D, a preferred embodiment of the printed circuit card PC1 including the ROM memory for the ball path indicator of the present invention will now be described commencing with the inputs 1P through 10P corresponding, respectively, to input terminals 8 through 17 together with the SET gate input at pin 5, the plus 10 volt DC applied to pin 2, and grounded input pin 1 and will commence from this common bank of input connections to the output connections BA1 through BA11 previously described with respect to FIGS. 2A and 2B.

Input terminal pins 8, 9, 10 and 11 corresponding, respectively, to input terminals 1P, 2P, 3P and 4P of the printed circuit board PC1 are connected through the reverse conducting direction of isolating diodes CR1, CR2, CR3 and CR4, respectively, to terminal pins 2, 3, 6 and 7 of an optical coupler U3. These terminal pin connections of the anodes of the isolating diodes CR1 through CR4 coupled to the cathodes of individual light emitting diodes illustrated at LED1 which drive light sensitive photo diode or switch LST1 to optically couple an input indication of a particular standing pin remaining on the alley after the first ball has been rolled. The various light emitting diodes within the optical coupler U3 have a driving bias applied thereto from a first LED driver circuit U1A having output terminal pins 2, 4, 5 and 6 connected, respectively, to apply driving bias voltages to the input terminal pins 1, 4, 5 and 8 of the optical coupler U3.

The first LED driver circuit U1A also has an output terminal pin 3 which is connected to supply driving bias to the terminal pin 1 of a second optical coupler U4 which includes an LED5 and a light sensitive transistor LST5 by way of illustration.

An additional or second LED driver circuit U1B has terminal pins 3, 4 and 6 connected, respectively, to terminal pins 4, 5 and 8 of the optical coupler U4 to provide driving bias to the balance of that circuit while a third optical coupler U5 is provided having an LED9 and an associated light sensitive transducer LST9 corresponding to the input terminal 9P with the second LED driver circuit U1B having terminal pins 2 and 5, respectively, applying bias to input terminal pins 1 and 4 of the said optical coupler U5. This completes the driving bias circuit for the optical couplers U3, U4 and U5.

The remaining input terminals 5P through 10P are connected through isolating diodes CR5 through CR10, respectively, with the terminal pins 2, 3, 6 and 7 of the optical coupler U4 and terminal pins 2 and 3 of the optical coupler U5. The emitters of the various light sensitive transistors such as LST1, LST5 and LST9 are all connected to ground through a common lead GL connected to the terminal pins 16, 13, 12 and 9 of the first optical coupler U3, the terminal pins 16, 13, 12 and 9 of the second optical coupler U4, and the terminal pins 8 and 5 of the third optical coupler U5. Power is supplied to the No. 1 terminal pins of the respective LED driver circuits U1A and U1B from the collector of the transistor Q2 of the PNP type which is connected at its emitter to the 10 volt power supply by a coupling diode CR11 conducting into the emitter. The base of the transistor Q2 is connected through a resistor R18 to the plus 10 volt power supply and through a resistor R17 and the forward conducting path of a coupling diode CR12 into the collector of an NPN transistor Q1, the latter having its emitter connected to ground and its base connected through a resistor R13 to ground and through a coupling resistor R12 to the terminal pin 13 of a NOR gate module U14, the latter having ganged terminal pins No. 11 and 12 connected in common to ganged terminal pins 5 and 6 of a NOR gate module U12 and terminal pin 11 of the Nor gate module U12.

The NOR gate module U12 has terminal pins 8 and 9 ganged together and connected through a resistor R14 to a plus 5 volt supply, through a capacitor C38 to ground and to the set gate terminal pin 5 of the input terminals of the printed circuit board PC1.

Terminal pin 10 of the NOR gate module U12 is connected to the ganged terminal pins 5 and 6 of that module; terminal pin 4 of that module is connected to ganged terminal pins 2 and 3 of that module; terminal pin 1 of that module is connected to a resistor R15 to terminal pin 12 of that module, the latter being connected to ground through a capacitor C2 and terminal pin 13 of that module is connected to ganged terminal pins 8 and 9 of yet another NOR gate module U13.

To complete the input terminal pin connection for the printed circuit board PC1, the input terminal pin 2 is connected to the plus 10 volt supply and thence to the terminal pin No. 1 of a voltage regulator module U17 having a terminal pin 3 connected to ground and a terminal pin 2 connected to provide a plus 5 volt output across a capacitor C1 which is connected to ground.

The input terminal pin 1 of the printed circuit board PC1 is grounded.

The U13 NOR gate module has a terminal pin 10 connected to ganged terminal pins 5 and 6 of that module which are further connected to a terminal pin 11 of that module. A terminal pin No. 4 of the NOR gate module U13 is connected to ganged terminal pins 2 and 3 of that module; a terminal pin 1 of that module is connected through a resistor R16 to the terminal pin 12 of that module and to ground through a capacitor C3 and the remaining terminal pin 13 of the NOR gate module U13 is connected to ganged terminal pins 8 and 9 of yet another NOR gate module U11.

Pin No. 13 of the Nor gate module U12 is also connected to pins 8, 9, 11 and 12 of yet another NOR gate module U8 to complete the interconnections of the modules U12 and U13 with the balance of the circuit of FIG. 3.

Three NOR gate modules U6, U7 and U8 provide an intricate connection between the optical couplers U3, U4 and U5, respectively, with the ROM memory chip U15.

The optical coupler U3 has output terminal pins 15, 14, 11 and 10 connected, respectively, with input terminal pins 8, 11, 3 and 6 of the NOR gate module U6. Terminal pin 7 of the NOR gate module U6 is grounded while terminal pins 9, 12, 2 and 5 are commonly driven by the terminal pin 10 of the NOR gate module U8 responsive to the output from terminal pin 13 of the NOR gate module U12 as will be hereinafter more fully described.

Optical coupler U4 has output terminal pins 15, 14, 11 and 10 which drive, respectively, input terminal pin numbers 8, 11, 3 and 5 of the NOR gate module U7, the latter having its terminal pin 9 driven by the terminal pin 10 of the module U8 and its terminal pins 12, 2 and 5 driven by the terminal pin 13 of the module U8, also responsive to the output from the terminal pin 13 of the module U12. Terminal pin number 7 of the module U7 is connected to ground as is terminal pin number 7 of the module U8. The optical coupler U5 has output terminal pins number 7 and number 6 which drive terminal pin numbers 3 and 6, respectively, of the NOR gate module U8, the latter having its terminal pins 2 and 5 jointly driven by the pin number 13 of the module U8 responsive to the output at terminal pin 13 of the module U12. A NOR gate driver circuit U2 is provided with its terminal pins 2, 3 and 4 connected to a plus 5 volt source and its terminal pin 14 connected to a plus 5 volt source and to ground through a capacitor C4. This is a decoupling capacitor between the plus 5 volt supply and ground and is also utilized in similar fashion by capacitors not shown connected to corresponding plus 5 volt biased terminal pins on modules U6 through U16 as will be described with respect to each of these modules. Thus, the capacitor C4 is a typical connection. Terminal pins 7, 5, 1 and 6 of the module U2 drive terminal pins 8, 11, 3 and 6, respectively, of the module U6. Terminal pins 8, 10, 11 and 9 drive terminal pins 8, 11, 3 and 6 of the NOR gate module U7. Terminal pins 13 and 12 of the NOR gate driver circuit U2 drive terminal pins 3 and 6, respectively, of the NOR gate module U8.

The output sides of the terminal modules U6, U7 and U8 are shown as including terminal pins 14 having a plus 5 volt indication adjacent thereto. These terminal pins 14 are each provided with a decoupling capacitor similar to the capacitor C4 for the NOR gate driver circuit U2.

The NOR gate module U6 has output terminal pins 10, 13, 1 and 4 which correspond, respectively, to ROM (PROM) input terminals pin numbers 5, 6, 7 and 4, respectively, which provide designated inputs $A_0$, $A_1$, $A_2$ and $A_3$, respectively, to the ROM (PROM) U15. A ground terminal pin number 8 is also provided in the ROM (PROM) U15.

The NOR gate module U7 includes output terminal pin numbers 10, 13, 1 and 4 which drive input terminal pin numbers 3, 2, 1 and 15, respectively, of the ROM (PROM) U15 thereby providing the respective ROM (PROM) inputs $A_4$, $A_5$, $A_6$ and $A_7$; and the NOR gate module U8 has output terminal pin numbers 1 and 4 which correspond to input terminal pin numbers 14 and 13, respectively, of the ROM (PROM) U15 thereby providing ROM (PROM) inputs A8 and A9, respectively.

Figure 3A:
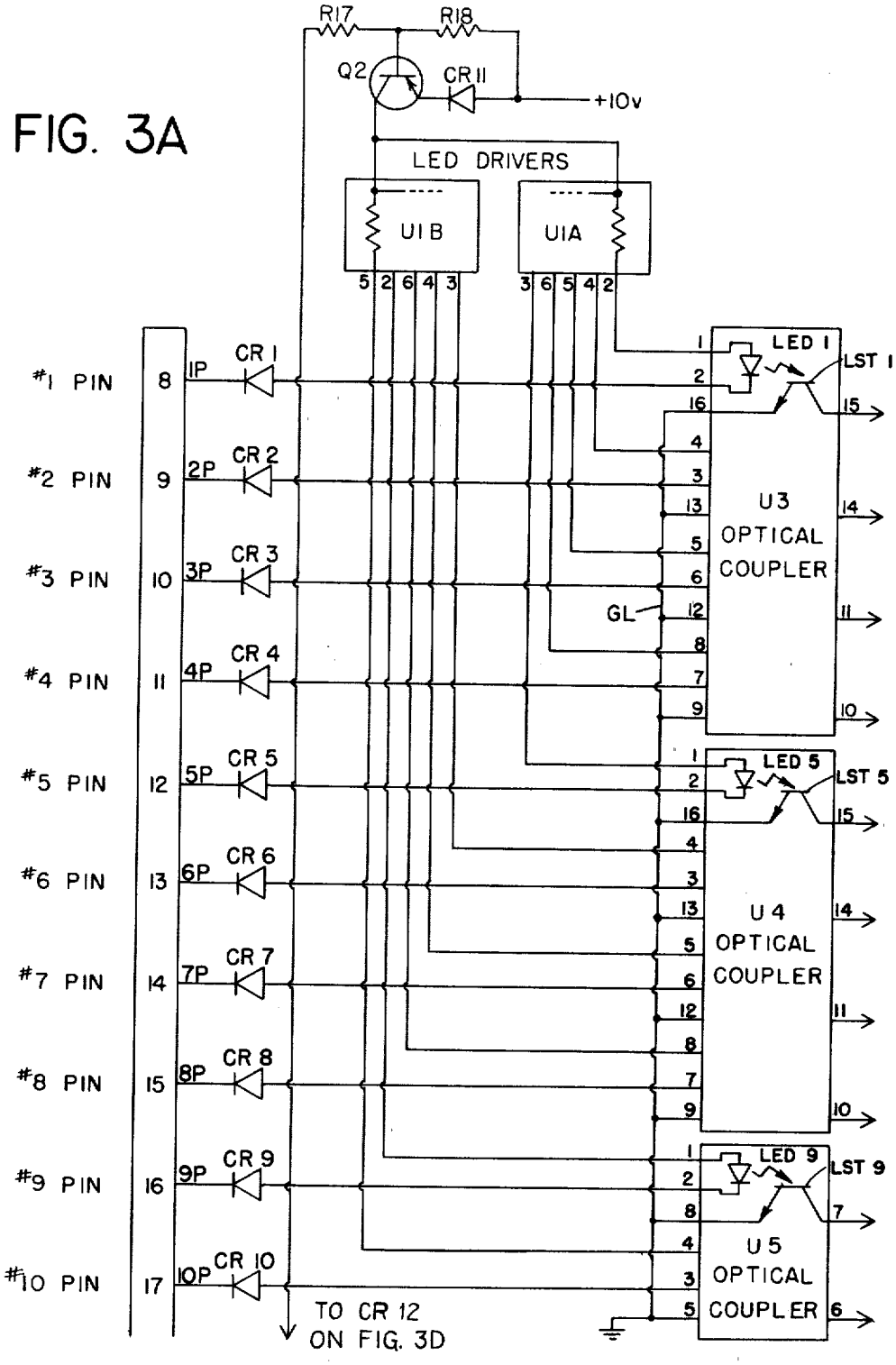
FIGS. 3A, 3B, 3C and 3D together constitute the schematic of the internal details of the printed circuit board generally shown in FIG. 2.
Figure 3B:
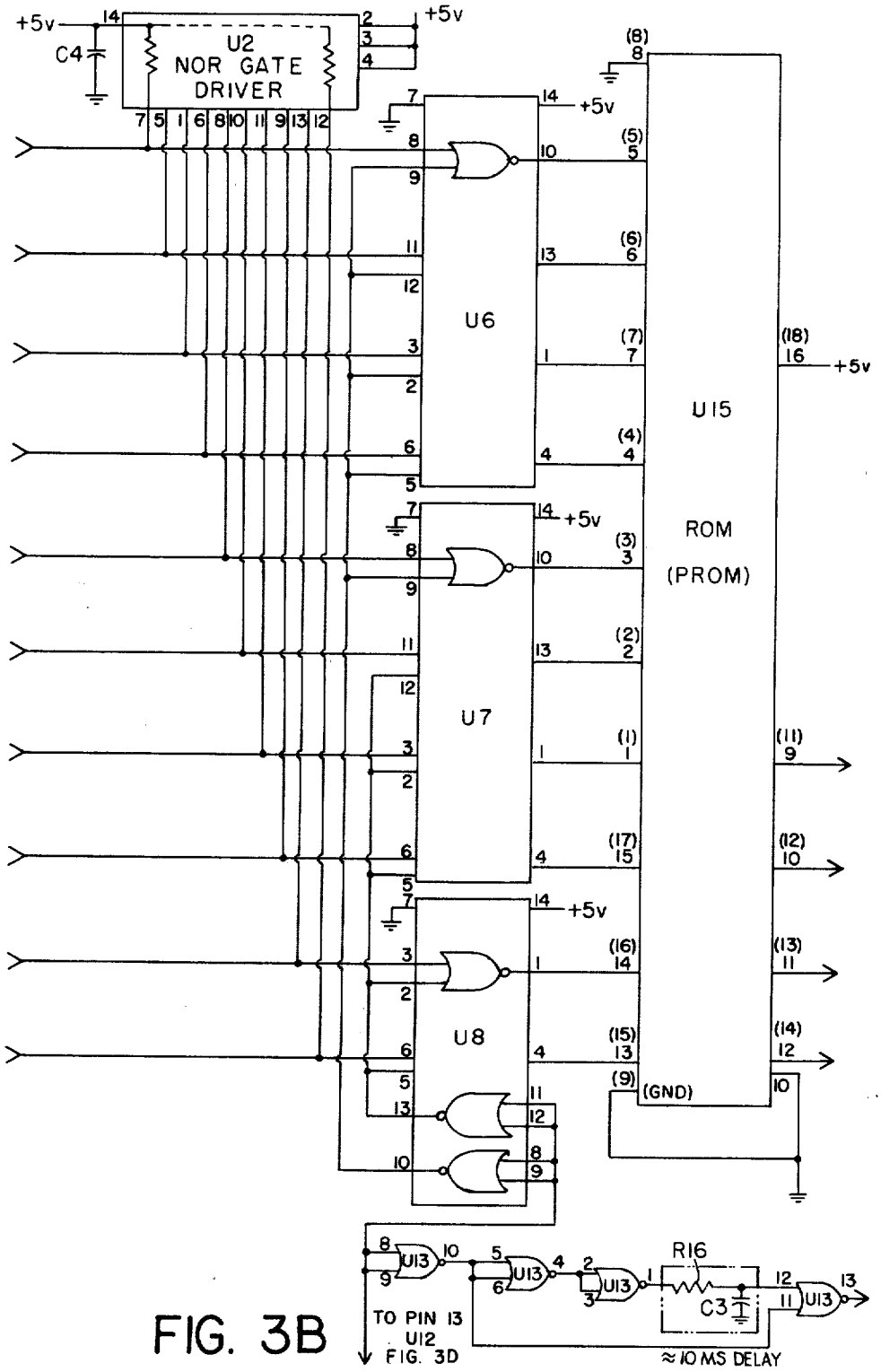
Figure 3C:
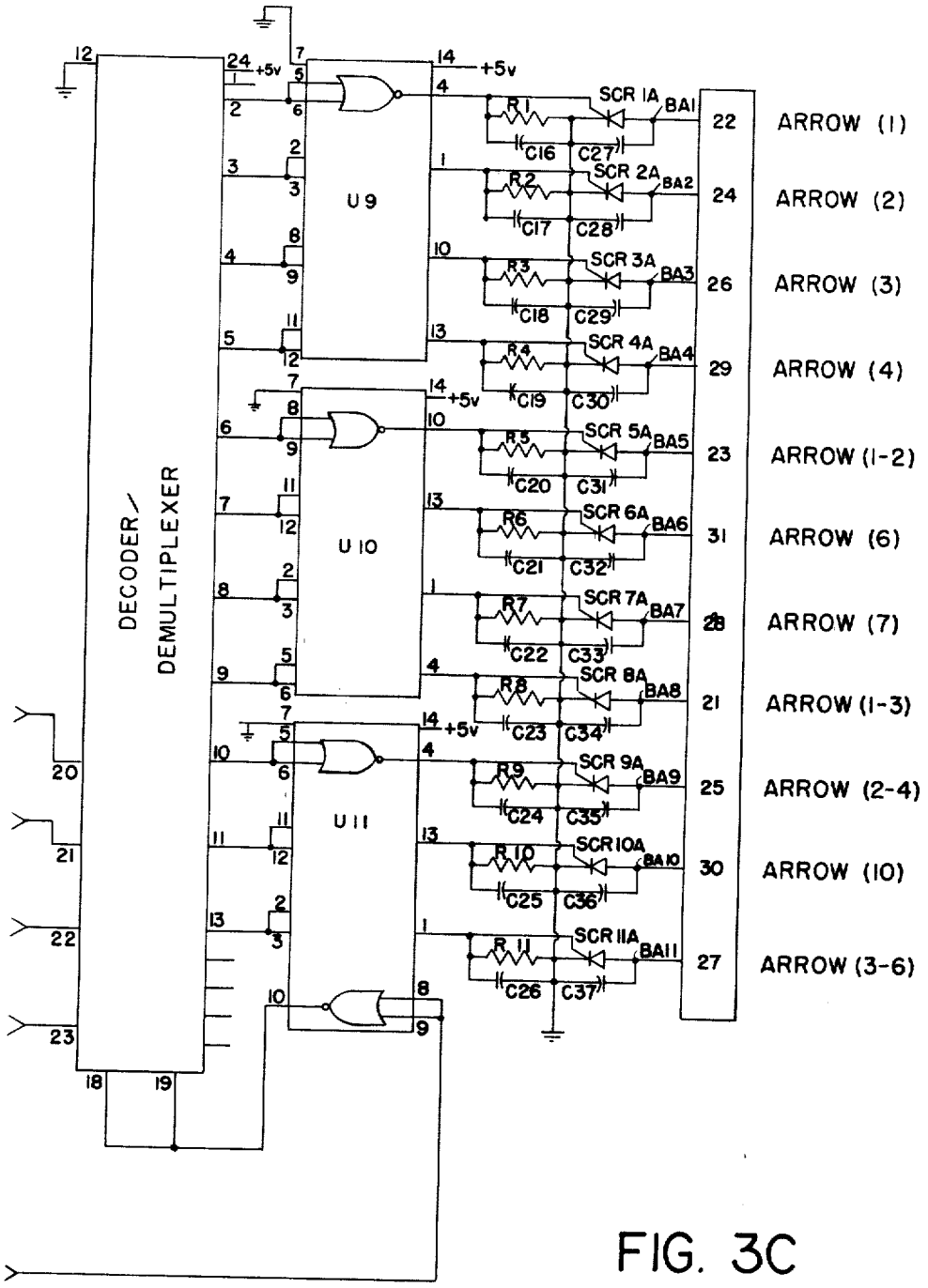

Several different versions of ROM (PROM) module U15 can be utilized such as, for example, a 16-pin ROM [Signetics 8228 (16 pin) ROM (1024×4) 4096 Bipolar I Package] which is designated by the plain terminal pin numbers or an 18-pin PROM [Signetics 825136/137 (18 pin) PROM (1024×4) 4096 Bipolar F Package] which is designated by the parenthetical pin numbers in FIG. 3B. The preferred embodiment will be described with respect to the ordinary terminal pin numbers and the parenthetical terminal pin numbers will be permitted to speak for themselves. The ROM (PROM) also includes the terminal pin number 16 which is a plus 5 volt bias terminal which, as previously described with regard to the NOR gate driver circuit U2, will have a decoupling capacitor connected between that terminal and ground.

The ROM (PROM) will have four outputs $O_1$, $O_2$, $O_3$ and $O_4$ corresponding, respectively, to output terminal pin numbers 12, 11, 10 and 9.

These output terminals 12, 11, 10 and 9 of the ROM U15 drive input terminal pins 23, 22, 21 and 20 corresponding, respectively, to the A, B, C, D inputs of a decoder/demultiplexer U16 where A comprises the least significant bit (LSB) and the D input comprises the most significant bit (MSB). The decoder/demultiplexer U16 is provided with a grounded terminal pin number 12 and with first and second gate terminals G1 and G2 ganged together by terminal pins 18 and 19 commonly connected to the output terminal pin 10 of the NOR gate module U11. The decoder/demultiplexer U16 has a terminal pin number 24 connected to the plus 5 volt source and this terminal pin will have a decoupling capacitor connected to ground therefrom as previously described with regard to the NOR gate driver circuit U2.

A terminal pin 1 is an unused terminal pin in the decoder/demultiplexer U16 while a terminal pin 2 comprises an output number 1 for the decoder/demultiplexer. Outputs 1 through 11 correspond to output terminal pins 2 through 11 & 13, respectively, of the decoder/demultiplexer U16. Unused outputs 12, 13, 14 and 15 correspond to unused terminal pins 14, 15, 16 and 17 as shown.

The outputs from the decoder/demultiplexer U16 are coupled to ball path arrow enabling circuits by means of NOR gate modules U9, U10 and U11 which will now be described.

The NOR gate module U9 has a grounded terminal pin number 7 and a plus 5 volt connected terminal pin number 14 which is provided with a decoupling capacitor in the manner previously described with respect to NOR gate driver U2. The NOR gate modules U10 and U11 also have similar terminal pin numbers 14 having a plus 5 volt supply connected thereto and also being provided with such decoupling capacitors.

Output terminal pins 2, 3, 4, and 5 are connected, respectively, to ganged terminal pins 5/6, 2/3, 8/9 and 11/12 of the NOR gate module U9.

Output terminal pins 6, 7, 8 and 9 of the decoder/demultiplexer U16 are respectively connected to ganged terminal pins 8/9, 11/12, 2/3 and 5/6 of the NOR gate module U10 and terminal pins 10, 11 and 13 of the decoder/demultiplexer U16 are respectively connected to ganged terminal pins 5/6, 11/12 and 2/3 of the NOR gate module U11.

The outputs BA1 through BA11 of the printed circuit card PC1 comprise the anode terminals of a plurality of silicon controlled rectifiers SCR1A through SCR11A, respectively, having their gate terminals directly connected to the output terminal pins 4, 1, 10 and 13 of the NOR gate module U9, 10, 13, 1 and 4 of the NOR gate module U10, and 4, 13, and 1 of the NOR gate module U11, respectively. The gate terminals and the just-listed output terminals of the modules U9, U10 and U11 are also respectively connected through resistors R1 through R11 to the cathode terminals of the SCRs SCR1A through SCR11A, respectively. Resistors R1 through R11 are respectively shunted by capacitors C16 through C26 and the anode cathode paths of the SCRs, SCR1A through SCR11A, are, respectively, shunted by capacitors C27 through C37, respectively, to complete the ball path arrow energization circuits.

As previously described with respect to FIG. 2B, the output terminals BA1 through BA11 correspond to printed circuit board PC1 output terminal pin numbers 22, 24, 26, 29, 23, 31, 28, 21, 25, 30 and 27, respectively. The particular ball path arrow legend corresponding to these pin numbers and to the outputs BA1 through BA11 are listed in FIG. 3C to the right of the said terminal pins.

This completes the detailed description of interconnections of FIG. 3.

OPERATION OF THE INVENTION

In the operation of the present invention, the pin fall and ball path indicator mask 12 in FIG. 1 bear the same identifying numerals for the standing pins as the pin lamps PL1 through PL10 and for particular ball paths by the ball path lamp numerals BPL1 through BPL11 in correlation to the legends printed next to these respective lamps in FIG. 2B.

For the sake of illustration, the operation of the present invention will be described on the assumption that the first ball has just been rolled and that the No. 1 and No. 2 pins remain standing as indicated by the standing pin indicator lamps PL1 and PL2, respectively. It is further assumed that the pin spotter machine has been actuated and the machine cable carrying the gripper switches GS1 through GS10 of FIG. 2A has been actuated through its 250° position in the first ball cycle and has picked up the No. 1 and No. 2 pins in its grippers, as well known in the art, thereby closing the gripper switches GS1 and GS2. The remaining gripper switches GS3 through GS10 remain open.

When the machine table advances to the 260° position in its cycle of operation, the SET GATE signal goes from a Lo state to a Hi state by virtue of the status signal S1 driving the base of the transistor T14 through the resistor R51 thereby turning the transistor T14 off to raise the potential of the SET GATE pin No. 5 in the printed circuit card PC1 to a Hi logic voltage.

Figure 3D:
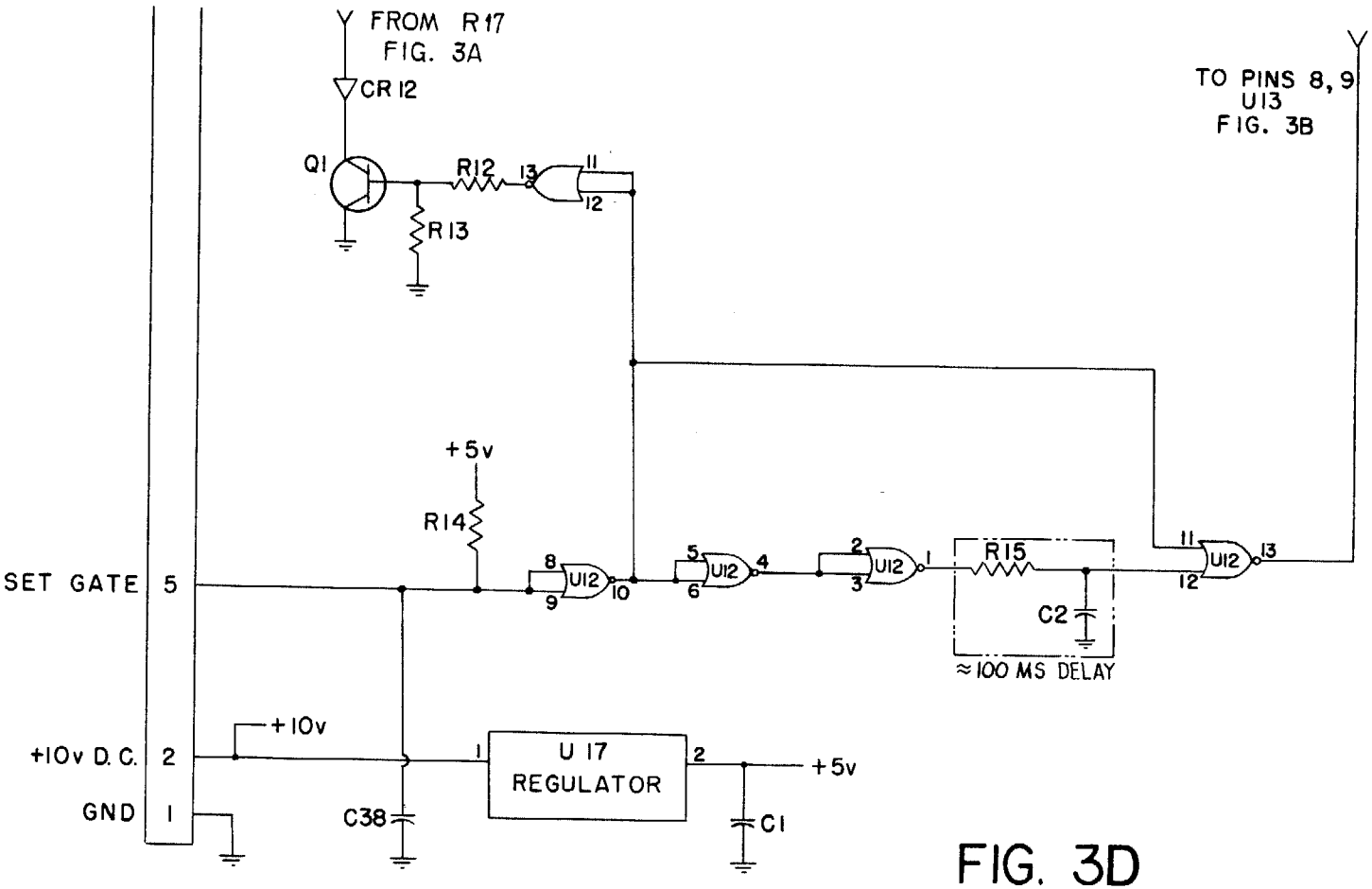

This results in the Nos. 8 and 9 terminal pins of the NOR module U12 to receive the SET GATE signal as illustrated in FIG. 3D and thence, through the output terminal pin 10, and the Nos. 11, 12 and 13 pins of the Norgate module U14, to drive the base of the transistor Q1 by means of the input resistors R12 and R13.

When the transistor Q1 is turned on, this causes the transistor Q2 to turn on through the resistor R17 and the coupling diode CR12. As a result, the transistor Q2 turns on the light emitting diodes in the optical coupler U3 which are coupled to the terminal pins 1/2 and 3/4 corresponding to the No. 1 and No. 2 pin input 1P and 2P of the ROM circuit card PC1.

These LEDs, comprising LED1 and LED2, the latter not being shown, are caused to be illuminated due to the turning on of the controlled rectifiers SCR1 and SCR2 on the printed circuit card PC4 of FIG. 2A in response to the closing of the gripper switches GS1 and GS2. The Q1 and Q2 transistor stages are thus used to limit the current drain on the pin spotter chassis only to the time in which the SET GATE signal is applied which corresponds to a 260° through a 350° machine table motion of the gripper switches which results in a SET GATE signal duration of approximately 1.5 seconds.

As a result of the actuation of the controlled rectifiers SCR1 and SCR2, the plus 12 volt filtered power supply is connected through the main connector PM at the pin E1 through the first and second standing pin indicator lamps PL1 and PL2 thence through, respectively, the pins E18 and E19 and the lines LD1 and LD2 through the diodes MBD1 and MBD2 and thence out through the said rectifiers to ground.

This bias is the logic sensing junctions RB1 and RB2 to low logic voltage levels of 0.5 to 1.5 volts while leaving the remaining logic sensing junctions RB3 through RB10 at a high or 12 to 14 volt logic level. Therefore, the No. 8 and No. 9 input pins on the printed circuit card PC1 corresponding to the 1P and 2P inputs are low and current is drawn through the light emitting diodes LED1 and LED2 causing the emission of light and the energization of the light sensing transistors LST1 and LST2 (the latter not shown) which result in output signals at terminal pins 15 and 14, respectively, of the optical coupler U3.

Referring further to FIG. 3D, the Nor gate module U12 is shown as a series connection of a multiplicity of Norgates driving a resistor R15 and capacitor C2 and the provision of a timing circuit insuring a proper time delay for stabilizing data voltages occasioned by the presence of standing pins prior to delivering data information to the ROM (PROM) module U15. After approximately 10 milliseconds have elapsed from the receipt of the SET GATE signal, pin No. 13 of the Norgate module U12 is driven to a Hi logic condition. This Hi logic state presents itself on pins 8 and 9 and 11 and 12 of the Norgate module U8. This causes the terminal pins 13 and 10 of the module U8 to go to a Lo state thereby gating any signals present on the input pins of the modules U6, U7 and U8 which exist from the optical coupler modules U3, U4 and U5. In the present example, signals at pins 8 and 11 of the module U6 from pins 15 and 14 of the module U3, respectively, are gated through to pins 10 and 13, respectively, of the module U6. Since the pins 15 and 14 of the module U3 are in a Lo state due to the action of the opto-isolators, a low set of signals is present at pins 8, 9 and 11/12 of the module U6 since the pins 9 and 12 are driven by the pins 13 and 10 of the module U8 as previously indicated. The NOR function then yields a Hi state output at pins 10 and 13 of the module U6 which correspond to addresses $A_0$ and $A_1$ (terminal pins 5 and 6, respectively) in the ROM (PROM) U15. The ROM (PROM) U15 is a positive logic device and therefore the modules U6, U7 and U8 perform both a gating and logic inversion function as an interface between the standing pin sensing circuits and the ROM (PROM) U15.

In keeping with the summation concept of address formulation set forth earlier herein, the address formed by a logical Hi at input addresses $A_0$ and $A_1$ is 3. At this location in the ROM (PROM) memory is a four-bit binary code or word which corresponds to the 1-2 ball paths which in turn corresponds to the ball path lamp and arrow BPL5. This is in keeping with the foregoing table representative of the address logic resulting in the selective actuation of the ball path lamps BPL1 through BPL11 on the mask 12.

When an address presents itself on the address inputs $A_0$ through $A_9$ of the ROM (PROM) (input terminal pins 5, 6, 7, 4, 3, 2, 1, 15, 14 and 13, respectively), a finite time must be allowed before the words stored in the ROM (PROM) may be read at the output pins 01 through 04 (terminal pins 12, 11, 10 and 9, respectively).

In order to properly utilize the various ROM/PROM combinations available from various manufacturers, the gating signals supplied to such devices are to be hard wired in the ON state so that when a particular ROM or PROM is used it is always enabled to respond to input addresses. In the event that certain types of ROM or PROM are supplied which do not have a gating means, then some other logic means may be used in a manner familiar to those of ordinary skill in the art.

The output word appearing at the output ports 01 through 04 of the ROM U15 is directly routed to the decoder/demultiplexer U16 at the inputs A through D, respectively, thereof (terminal pins 23, 22, 21 and 20, respectively). The decoder/demultiplexer U16 decodes the ROM word received into a unique output for every combination of binary input as defined by the ROM word. This particular ROM word is illustrated in the ROM output table as 1010 proceeding from the output 01 to the output 04, respectively. Thus, the A, B, C, D input for the decoder/demultiplexer is likewise a 1010 in that order. This is representative of the desirability of illuminating the arrow defining the 1-2 ball path. Hence, a 1-0-1-0 input at the A-B-C-D terminals of the decoder/demultiplexer should result in the energization of the controlled rectifier SCR5A and the ball path lamp BPL5. With this inmind, the description of operation will proceed toward that end.

The decoder/demultiplexer U16 will present a Lo logic level at its number 5 output which corresponds to the number 6 output terminal pin thereof, thereby applying this Lo logic level to the number 8 and number 9 terminal pins of the Norgate module U10 causing a logic inversion resulting in a Hi logic level at the output terminal pin 10 of the Norgate module U10, thereby biasing the gate terminal of the controlled rectifier SCR5A to turn on the controlled rectifier SCR5A and illuminate the ball path lamps BPL5 through the output BA5 and terminal pin 23 of the printed circuit card PC1. Going back to FIG. 2B, it is noted that the master interconnector has a terminal pin E15 which corresponds to the output BA5 and terminal pin 23 of the printed circuit card PC1 to which the ball path lamps BPL5 (all four of them) is connected. The other side of this ball path lamp BPL5 is connected through a common lead to the plus 12 volt filtered power supply and is thereby energized through the controlled rectifier SCR5A which is connected to ground at its cathode.

To maintain proper synchronization between the ROM and the demultiplexer, the gating signal for the demultiplexer U16 is formed by a time delay of approximately 10 milliseconds consisting of the NOR gate module U13, the resistor R16 and the capacitor C3. This time delay begins its timing cycle after the time delay formed by the preceding NOR gate module U12, resistor R15 and the capacitor C2 times out.

When this 10 ms. time delay times out, then the G1 and G2 gate terminals (terminal pins 18 and 19, respectively) in the decoder/demultiplexer are driven to a Lo state since they have been inverted by the NOR gate in the NOR gate module U11 (terminal pin 10 thereof) which in turn has been energized through its terminal pins 8 and 9 from the terminal pin 13 of the preceding NOR gate module U13. All other output pins of the decoder/demultiplexer are held in a Hi logic state. This time delay is provided to compensate for any settling time required for the change in ROM (PROM) address to be outputed.

The number 5 output of the decoder/demultiplexer U16 being in a Lo state is inverted in the NOR gate module U10 as previously described. Thus, the NOR gate modules U9, U10 and U11 with the exception of the last available NOR gate in U11 act as inverter drivers for the output of the decoder/demultiplexer in presenting proper logic levels associated therewith to the gates of the respective controlled rectifiers SCR1A through SCR11A representative of the ball path outputs BA1 through BA11, respectively, as well as the ball path lamps BPL1 through BPL11, respectively.

With regard to the controlled rectifier SCR5A, the resistor R5 associated therewith forms a gate to cathode voltage developing resistor while the capacitors C20 and C31 associated therewith form a capacitor network to suppress voltage transients. Similar networks are formed by the resistor/capacitor networks associated with the other controlled rectifiers SCR1A through SCR11A.

The controlled rectifier SCR5A remains in the ON state by means of the filtered plus 12 volt supply from the control chassis and no further action is required by the ROM circuitry after a specific SCR has been selected. The entire action described above occurs in milliseconds and accordingly, (the use of) a 1.5 second SET GATE signal is used as the only main control signal for the entire device.

As can be seen from the foregoing description of the invention and the description of operation thereof, the occurrence of the closure of gripper switches GS1 through GS10 is sensed as a Lo logic condition and transmitted through suitable isolation and logic conversion circuits to a positive logic ROM (PROM) where the addresses are cumulatively coded by adding the weighted significance of the standing pin inputs in keeping with the weighted value address tables. These inputs result in the generation of stored code words representative of particular addresses which, by means of a decoder/demultiplexer, are codes corresponding to specific ball path arrows illuminated by the ball path lamps BPL1 through BPL11 and illustrated on the face of the ball path and standing pin mask 12 as basically shown in FIG. 1. Thus, there is a very simplistic direct, instantaneous and simple input-to-output conversion of standing pin data to optimum ball path direction correlated to that standing pin data for maximum effectiveness assuming a ball can be rolled true in accordance with the indicated ball path.

Parts List

| Reference | Vendor | Vendor Number | Description |
|---|---|---|---|
| U1A | Bourns - Trimpot Product Division | #4306R-101-471 | Resistor Network 470 OHM ± 2% |
| U1B | Bourns - Trimpot Product Division | #4306R-101-471 | Resistor Network 470 OHM ± 2% |
| U2 | Bourns - Trimpot | #4114R-022-103 | Resistor Network 10K OHM 14 Pin D.I.P. |
| U3 | LINTRONIX | ILQ74 | Opto Isolator ILQ-74 16 Pin D.I.P. |
| U4 | LINTRONIX | ILQ74 | Opto Isolator ILQ-74 16 Pin D.I.P. |
| U5 | LINTRONIX | ILD-74 | Opto Isolator ILD-74 8 Pin D.I.P. |
| U6-U13 | HARRIS<br>NATIONAL<br>TELEDYNE S | HD 74C02<br>MM 74C02<br>MM 74C02 | POS. NORGATE 74C02 14 Pin D.I.P. |
| U14 | SIGNETICS<br>MOTOROLA<br>NATIONAL<br>T.I. | N7402<br>MC 7402D<br>DM 7402N<br>SN 7402N | POS. NORGATE N7402 14 Pin D.I.P. |
| U15 | SIGNETICS | 8228 | 4096-BIT BIPOLAR ROM (1024 × 4) (16 Pin) |
| | SIGNETICS | 82S136/137 | 4096-BIT BIPOLAR PROM (1024 × 4) (18 Pin) |
| | MONOLITHIC MEMORIES, INC. | P/N 6353-1J | PROM 4K (1024 × 4) (18 Pin) |
| U16 | NATIONAL<br>TELEDYNE S | MM 74C154<br>MM 74C154 | Decoder/Multiplexer 74C154 |

-continued

Parts List

| Reference | Vendor | Vendor Number | Description |
|---|---|---|---|
| | HARRIS | HD 74C154 | 24 Pin D.I.P. (4 line to 16 line) |

Figure 4:
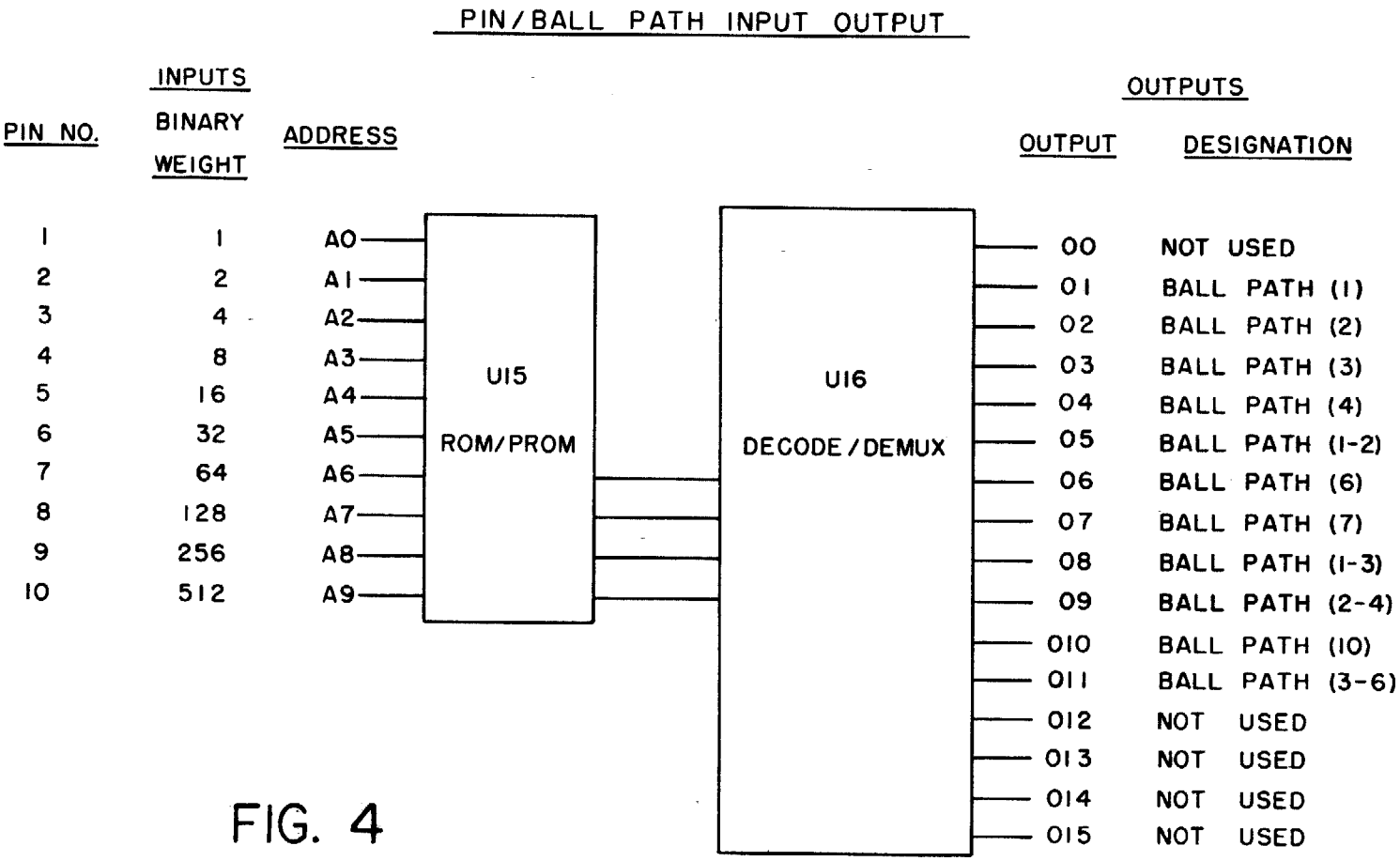
FIG. 4 is a diagram illustrating the pin/ball inputs and outputs assignments.

The following data sheets on the commercially available integrated circuit chips utilized with the present invention as described hereinbefore with reference to the Figures are incorporated by reference into the disclosure of the application:

- Data Sheet MM 74CO2 Quad 2-input NORGATE by National Semiconductor
- Data Sheet ILD-74 (Opto Isolators pgs. 21, 35) by LINTRONIX
- Data Sheet ILQ-74 (Opto Isolators pgs. 21, 35) by LINTRONIX
- Data Sheet Model 4306R-101 (SIP resistor networks pg. 10) by Bourns-Trimpot Division
- Data Sheet Model 4308R-101 (SIP resistor networks pg. 10) by Bourns-Trimpot Division
- Data Sheet MM54C154/MM74C154 (pgs. 48–50) by National Semiconductor
- Data Sheet 4096-BIT Bipolar ROM (pgs. 28, 53) by SIGNETICS
- Data Sheet 54/74 Families of Compatible TTL Circuits (pgs. 5–9) by Texas instruments
- Data Sheet 54/74 SS1 Devices by National Semiconductor Any suitable software may be used. Applicant's worksheet for ROM content computation is set forth below. The below address computation may be better understood with reference to FIG. 4 which illustrates the ROM/PROM U15 content compulation and decoder output code significance.

ADDRESS COMPUTATION:

Weight-Assignment:

| | | | |
|---|---|---|---|
| Pin #1 | Weight = 1 | Pin #6 | Weight = 32 |
| Pin #2 | Weight = 2 | Pin #7 | Weight = 64 |
| Pin #3 | Weight = 4 | Pin #8 | Weight = 128 |
| Pin #4 | Weight = 8 | Pin #9 | Weight = 256 |
| Pin #5 | Weight = 16 | Pin #10 | Weight = 512 |

Ball Path Designation:

| | |
|---|---|
| Ball Path (1) | Designation = 1 |
| Ball Path (2) | Designation = 2 |
| Ball Path (3) | Designation = 3 |
| Ball Path (4) | Designation = 4 |
| Ball Path (1-2) | Designation = 5 |
| Ball Path (6) | Designation = 6 |
| Ball Path (7) | Designation = 7 |
| Ball Path (1-3) | Designation = 8 |
| Ball Path (2-4) | Designation = 9 |
| Ball Path (10) | Designation = 10 |
| Ball Path (3-6) | Designation = 11 |

Address Determined By Sum of Pin Weights

BALL PATH RANGES

| LEAVE (Address) | BALL PATH | LEAVE (Address) | BALL PATH |
|---|---|---|---|
| 10 | (10) | 5-6-7 | (3) |
| 9 | (3) | 5-6-7-10 | (3) |
| 9-10 | (6) | 5-6-7-9 | (3) |
| 8 | (2) | 5-6-7-9-10 | (3) |
| 8-10 | (2) | 5-6-7-8 | (3) |
| 8-9 | (1) | 5-6-7-8-10 | (3) |
| 8-9-10 | (1) | 5-6-7-8-9 | (3) |
| 7 | (7) | 5-6-7-8-9-10 | (3) |
| 7-10 | (7) | 4 | (4) |
| 7-9 | (7) | 4-10 | (7) |
| 7-9-10 | (6) | 4-9 | (7) |

-continued

ADDRESS COMPUTATION:

| | | | |
|---|---|---|---|
| 7-8 | (4) | 4-9-10 | (7) |
| 7-8-10 | (4) | 4-8 | (2-4) |
| 7-8-9 | (4) | 4-8-10 | (7) |
| 7-8-9-10 | (4) | 4-8-9 | (7) |
| 6 | (6) | 4-8-9-10 | (7) |
| 6-10 | (10) | 4-7 | (7) |
| 6-9 | (3-6) | 4-7-10 | (7) |
| 6-9-10 | (6) | 4-7-9 | (7) |
| 6-8 | (10) | 4-7-9-10 | (7) |
| 6-8-10 | (10) | 4-7-8 | (4) |
| 6-8-9 | (10) | 4-7-8-10 | (7) |
| 6-8-9-10 | (10) | 4-7-8-9 | (7) |
| 6-7 | (10) | 5-6-8 | (3) |
| 6-7-10 | (10) | 4-7-8-9-10 | (7) |
| 6-7-9-10 | (10) | 4-6 | (4) |
| 6-7-8 | (10) | 4-6-10 | (6) |
| 6-7-8-10 | (10) | 4-6-9 | (3-6) |
| 6-7-8-9 | (10) | 4-6-9-10 | (6) |
| 6-7-8-9-10 | (10) | 4-6-8 | (2-4) |
| 5 | (1) | 4-6-8-10 | (10) |
| 5-10 | (1-2) | 4-6-8-9 | (2-4) |
| 5-9 | (1-3) | 4-6-8-9-10 | (10) |
| 5-9-10 | (1-2) | 4-6-7 | (4) |
| 5-8 | (1-2) | 4-6-7-10 | (7) |
| 5-8-10 | (1-2) | 4-6-7-9 | (7) |
| 5-8-9 | (1-3) | 4-6-7-9-10 | (10) |
| 5-8-9-10 | (1-2) | 4-6-7-8 | (4) |
| 5-7 | (1-3) | 4-6-7-8-10 | (7) |
| 5-7-10 | (1-3) | 4-6-7-8-9 | (7) |
| 5-7-9 | (1-3) | 4-6-7-8-9-10 | (10) |
| 5-7-9-10 | (1-2) | 4-5 | (2) |
| 5-7-8 | (1-3) | 4-5-10 | (2) |
| 5-7-8-10 | (1-3) | 4-5-9 | (2) |
| 5-7-8-9 | (1-3) | 4-5-9-10 | (2) |
| 5-7-8-9-10 | (1-2) | 4-5-8 | (2) |
| 5-6 | (3) | 4-5-8-10 | (2) |
| 5-6-10 | (3) | 4-5-8-9 | (2) |
| 5-6-9 | (3) | 4-5-8-9-10 | (2) |
| 5-6-9-10 | (3) | 4-5-7 | (2) |
| 6-7-9 | (10) | 4-5-7-10 | (2) |
| 5-6-8-10 | (3) | 4-5-7-9 | (2) |
| 5-6-8-9 | (3) | 4-5-7-9-10 | (2) |
| 5-6-8-9-10 | (3) | 4-5-7-8 | (2) |
| 4-5-7-8-10 | (2) | 3-5-9 | (1-3) |
| 4-5-7-8-9 | (2) | 3-5-9-10 | (1-3) |
| 4-5-7-8-9-10 | (2) | 3-5-8 | (1-3) |
| 4-5-6 | (2) | 3-5-8-10 | (1-3) |
| 4-5-6-10 | (2) | 3-5-8-9 | (1-3) |
| 4-5-6-9 | (2) | 3-5-8-9-10 | (1-3) |
| 4-5-6-9-10 | (2) | 3-5-7 | (3-6) |
| 4-5-6-8 | (2) | 3-5-7-10 | (3-6) |
| 4-5-6-8-10 | (2) | 3-5-7-9 | (3) |
| 4-5-6-8-9 | (2) | 3-5-7-9-10 | (3) |
| 4-5-6-8-9-10 | (2) | 3-5-7-8 | (1-3) |
| 4-5-6-7 | (2) | 3-5-7-8-10 | (1-3) |
| 4-5-6-7-10 | (2) | 3-5-7-8-9 | (1-3) |
| 4-5-6-7-9 | (2) | 3-5-7-8-9-10 | (1-3) |
| 4-5-6-7-9-10 | (2) | 3-5-6 | (3) |
| 4-5-6-7-8 | (2) | 3-5-6-10 | (3-6) |
| 4-5-6-7-8-10 | (2) | 3-5-6-9 | (3) |
| 4-5-6-7-8-9 | (2) | 3-5-6-9-10 | (3-6) |
| 4-5-6-7-8-9-10 | (2) | 3-5-6-8 | (1-3) |
| 3 | (3) | 3-5-6-8-10 | (3-6) |
| 3-10 | (3-6) | 3-5-6-8-9 | (1-3) |
| 3-9 | (3) | 3-4-6-10 | (3-6) |
| 3-6-7-8-10 | (3-6) | 3-4-6-9 | (3-6) |
| 3-9-10 | (3) | 3-5-6-7 | (3-6) |
| 3-8 | (1-3) | 3-5-6-7-10 | (3-6) |
| 3-8-10 | (3-6) | 3-5-6-7-9 | (3-6) |
| 3-8-9 | (1-3) | 3-5-6-7-9-10 | (3-6) |
| 3-8-9-10 | (3-6) | 3-5-6-7-8 | (1-3) |
| 3-7 | (3-6) | 3-5-7-8-10 | (3-6) |
| 3-7-10 | (3-6) | 3-5-7-8-9 | (1-3) |
| 3-7-9 | (3) | 3-5-6-7-8-9-10 | (3-6) |
| 3-7-9-10 | (3-6) | 3-4 | (3-6) |
| 3-7-8 | (3-6) | 3-4-10 | (3-6) |
| 3-7-8-10 | (3-6) | 3-4-9 | (3) |
| 3-7-8-9 | (1-3) | 3-4-9-10 | (3-6) |
| 3-7-8-9-10 | (3-6) | 3-4-8 | (2-4) |
| 3-6 | (3-6) | 3-4-8-10 | (3-6) |
| 3-6-10 | (3-6) | 3-4-8-9 | (3) |

-continued

ADDRESS COMPUTATION:

| | | | |
|---|---|---|---|
| 3-6-9 | (3) | 3-4-8-9-10 | (3-6) |
| 3-6-9-10 | (3-6) | 3-4-7 | (7) |
| 3-6-8 | (1-3) | 3-4-7-10 | (3-6) |
| 3-6-8-10 | (3-6) | 3-4-7-9 | (7) |
| 3-6-8-9 | (3-6) | 3-4-7-9-10 | (3-6) |
| 3-6-8-9-10 | (3-6) | 3-4-7-8 | (4) |
| 3-6-7 | (3-6) | 3-4-7-8-10 | (3-6) |
| 3-6-7-10 | (3-6) | 3-4-7-8-9 | (7) |
| 3-6-7-9 | (3-6) | 3-4-7-8-9-10 | (3-6) |
| 3-6-7-9-10 | (3-6) | 3-4-6 | (3-6) |
| 3-6-7-8 | (3-6) | 3-4-5-7-9-10 | (2) |
| 3-5-6-8-9-10 | (3-6) | 3-4-5-7-8 | (2) |
| 3-6-7-8-9 | (3-6) | 3-4-6-9-10 | (3-6) |
| 3-6-7-8-9-10 | (3-6) | 3-5-6-8 | (3-6) |
| 3-5 | (1-3) | 3-4-6-8-10 | (3-6) |
| 3-5-10 | (3-6) | 3-4-6-8-9 | (3-6) |
| 3-5-10 | (3-6) | 3-4-6-8-9 | (3-6) |
| 3-4-6-8-9-10 | (3-6) | 2-7-8-9 | (1-2) |
| 3-4-6-7 | (3-6) | 2-7-8-9-10 | (1-2) |
| 3-4-6-7-10 | (3-6) | 2-6 | (2-4) |
| 3-4-6-7-9 | (3-6) | 2-6-10 | (10) |
| 3-4-6-7-9-10 | (3-6) | 2-6-9 | (3-6) |
| 3-4-6-7-8 | (3-6) | 2-6-9-10 | (6) |
| 3-4-6-7-8-10 | (3-6) | 2-6-8 | (2) |
| 3-4-6-7-8-9 | (3-6) | 2-6-8-10 | (10) |
| 3-4-6-7-8-9-10 | (3-6) | 2-6-8-9 | (1-2) |
| 3-4-5 | (2) | 2-6-8-9-10 | (1-2) |
| 3-4-5-10 | (2) | 2-6-7 | (2-4) |
| 3-4-5-9 | (2) | 2-6-7-10 | (2-4) |
| 3-4-5-9-10 | (2) | 2-6-7-9 | (2-4) |
| 3-4-5-8 | (2) | 2-6-7-9-10 | (2-4) |
| 3-4-5-8-10 | (2) | 2-6-7-8 | (2) |
| 3-4-5-8-9 | (2) | 2-6-7-8-10 | (2-4) |
| 3-4-5-8-9-10 | (2) | 2-6-7-8-9 | (1-2) |
| 3-4-5-7 | (2) | 2-5-6-7-10 | (2-4) |
| 3-4-5-7-10 | (2) | 2-5-6-7-9 | (2-4) |
| 3-4-5-7-9 | (2) | 2-5-6-7-9-10 | (2-4) |
| 2-8-10 | (2) | 2-5-6-7-8 | (2) |
| 2-8-9 | (1-2) | 2-5-9 | (1-2) |
| 2-8-9-10 | (1-2) | 2-5-9-10 | (2-4) |
| 3-4-5-7-8-10 | (2) | 2-5-8 | (1-2) |
| 3-4-5-7-8-9 | (2) | 2-5-8-10 | (2) |
| 3-4-5-7-8-9-10 | (2) | 2-5-8-9 | (1-2) |
| 3-4-5-6 | (2) | 2-5-8-9-10 | (2) |
| 3-4-5-6-10 | (2) | 2-5-7 | (2-4) |
| 3-4-5-6-9 | (2) | 2-5-7-10 | (2-4) |
| 3-4-5-6-9-10 | (2) | 2-5-7-9 | (2-4) |
| 3-4-5-6-8 | (2) | 2-5-7-9-10 | (2-4) |
| 3-4-5-6-8-10 | (2) | 2-5-7-8 | (2) |
| 3-4-5-6-8-9 | (2) | 2-5-7-8-10 | (2) |
| 3-4-5-6-8-9-10 | (2) | 2-5-7-8-9 | (2) |
| 3-4-5-6-7 | (2) | 2-5-7-8-9-10 | (2) |
| 3-4-5-6-7-10 | (2) | 2-5-6 | (1-2) |
| 3-4-5-6-7-9 | (2) | 2-5-6-10 | (3) |
| 3-4-5-6-7-9-10 | (2) | 2-5-6-9 | (1-2) |
| 3-4-5-6-7-8 | (2) | 2-5-6-9-10 | (3) |
| 3-4-5-6-7-8-10 | (2) | 2-5-6-8 | (1-2) |
| 3-4-5-6-7-8-9 | (2) | 2-5-6-8-10 | (2) |
| 3-4-5-6-7-8-9-10 | (2) | 2-5-6-8-9 | (1-2) |
| 2 | (2) | 2-5-6-8-9-10 | (2) |
| 2-10 | (2-4) | 2-5-6-7 | (2-4) |
| 2-9 | (1-2) | 2-4-6-9-10 | (2-4) |
| 2-9-10 | (2-4) | 2-4-6-8 | (2-4) |
| 2-8 | (2) | 2-4-6-8-10 | (2-4) |
| 2-6-7-8-9-10 | (1-2) | 2-4-6-8-9 | (1-2) |
| 2-5 | (1-2) | 2-5-6-7-8-10 | (2) |
| 2-5-10 | (2-4) | 2-5-6-7-8-9 | (2) |
| 2-7 | (2-4) | 2-5-6-7-8-9-10 | (2) |
| 2-7-10 | (2-4) | 2-4 | (2-4) |
| 2-7-9 | (2-4) | 2-4-10 | (2-4) |
| 2-7-9-10 | (2-4) | 2-4-9 | (2-4) |
| 2-7-8 | (2) | 2-4-9-10 | (2-4) |
| 2-7-8-10 | (2-4) | 2-4-8 | (2) |
| 2-4-8-10 | (2-4) | 2-4-5-6-7-9 | (1-2) |
| 2-4-8-9 | (1-2) | 2-4-5-6-7-9-10 | (2-4) |
| 2-4-8-9-10 | (1-2) | 2-4-5-6-7-8 | (1-2) |
| 2-4-7 | (2-4) | 2-4-5-6-7-8-10 | (2-4) |
| 2-4-7-10 | (2-4) | 2-4-5-6-7-8-9 | (1-2) |
| 2-4-7-9 | (2-4) | 2-4-5-6-7-8-9-10 | (2-4) |
| 2-4-7-9-10 | (2-4) | 2-3 | (1) |
| 2-4-7-8 | (2) | 2-3-10 | (1) |

-continued

ADDRESS COMPUTATION:

| | | | |
|---|---|---|---|
| 2-4-7-8-10 | (2-4) | 2-3-9 | (1) |
| 2-4-7-8-9 | (1-2) | 2-3-9-10 | (1) |
| 2-4-7-8-9-10 | (1-2) | 2-3-8 | (1) |
| 2-4-6 | (2-4) | 2-3-8-10 | (1) |
| 2-4-6-10 | (2-4) | 2-3-8-9 | (1) |
| 2-4-6-9 | (2-4) | 2-3-5-10 | (1) |
| 2-4-5-7-8-10 | (2-4) | 2-3-5-9 | (1) |
| 2-4-5-7-8-9 | (1-2) | 2-3-5-9-10 | (1) |
| 2-4-5-7-8-9-10 | (2-4) | 2-3-5-8 | (1) |
| 2-3-5-6 | (1-2) | 2-3-5-8-10 | (1) |
| 2-4-5-6-10 | (2-4) | 2-3-5-8-9 | (1) |
| 2-4-6-8-9-10 | (1-2) | 2-3-7-8 | (1) |
| 2-4-6-7 | (2-4) | 2-3-7-8-10 | (1) |
| 2-4-6-7-10 | (2-4) | 2-3-7-8-9 | (1) |
| 2-4-6-7-9 | (2-4) | 2-3-7-8-9-10 | (1) |
| 2-4-6-7-9-10 | (2-4) | 2-3-6 | (1) |
| 2-4-6-7-8 | (2-4) | 2-3-6-10 | (1) |
| 2-4-6-7-8-10 | (2-4) | 2-3-6-9 | (1) |
| 2-4-6-7-8-9 | (1-2) | 2-3-6-9-10 | (1) |
| 2-4-6-7-8-9-10 | (1-2) | 2-3-6-8 | (1) |
| 2-4-5 | (1-2) | 2-3-6-8-10 | (1) |
| 2-4-5-10 | (2-4) | 2-3-6-8-9 | (1) |
| 2-4-5-9 | (1-2) | 2-3-6-8-9-10 | (1) |
| 2-4-5-9-10 | (2-4) | 2-3-6-7 | (1) |
| 2-4-5-8 | (1-2) | 2-3-6-7-10 | (1) |
| 2-4-5-8-10 | (2) | 2-3-6-7-9 | (1) |
| 2-4-5-8-9 | (1-2) | 2-3-6-7-9-10 | (1) |
| 2-4-5-8-9-10 | (1-2) | 2-3-6-7-8-10 | (1) |
| 2-4-5-7-10 | (2-4) | 2-3-6-7-8-9 | (1) |
| 2-4-5-7-9 | (1-2) | 2-3-6-7-8-9-10 | (1) |
| 2-4-5-7-9-10 | (2-4) | 2-3-5 | (1) |
| 2-4-5-7-8 | (1-2) | 2-3-5-6-7-8 | (1) |
| 2-3-8-9-10 | (1) | 2-3-5-6-7-8-10 | (1) |
| 2-3-7 | (1) | 2-3-5-6-7-8-9 | (1) |
| 2-3-7-10 | (1) | 2-3-5-6-7-8-9-10 | (1) |
| 2-3-7-9 | (1) | 2-3-4 | (1) |
| 2-3-7-9-10 | (1) | 2-3-4-10 | (1) |
| 2-4-5-6-9 | (1-2) | 2-3-5-8-9-10 | (1) |
| 2-4-6-9-10 | (2-4) | 2-3-5-7 | (1) |
| 2-4-5-6-8 | (1-2) | 2-3-5-7-10 | (1) |
| 2-4-5-6-8-10 | (2) | 2-3-5-7-9 | (1) |
| 2-4-5-6-8-9 | (1-2) | 2-3-5-7-9-10 | (1) |
| 2-4-5-6-8-9-10 | (2) | 2-3-5-7-8 | (1) |
| 2-4-5-6-7 | (1-2) | 2-3-5-7-8-10 | (1) |
| 2-4-5-6-7-10 | (2-4) | 2-3-5-7-8-9 | (1) |
| 2-3-5-7-8-9-10 | (1) | 2-3-4-5-7 | (1) |
| 2-3-5-6 | (1) | 2-3-4-5-7-10 | (1) |
| 2-3-5-6-10 | (1) | 2-3-4-5-7-9 | (1) |
| 2-3-5-6-9 | (1) | 2-3-4-5-7-9-10 | (1) |
| 2-3-5-6-9-10 | (1) | 2-3-4-6-7-8-10 | (1) |
| 2-3-5-6-8 | (1) | 1 | (1) |
| 2-3-5-6-8-10 | (1) | 1-10 | (1-2) |
| 2-3-5-6-8-9 | (1) | 1-9 | (1-3) |
| 2-3-5-6-8-9-10 | (1) | 1-9-10 | (1-2) |
| 2-3-5-6-7 | (1) | 1-8 | (1-2) |
| 2-3-5-6-7-10 | (1) | 1-8-10 | (1-2) |
| 2-3-5-6-7-9 | (1) | 1-8-9 | (1) |
| 2-3-5-6-7-9-10 | (1) | 1-8-9-10 | (1-2) |
| 2-3-4-6-8-9-10 | (1) | 1-7 | (1-3) |
| 2-3-4-6-7 | (1) | 1-7-10 | (1-2) |
| 2-3-4-6-7-10 | (1) | 1-7-9 | (1-3) |
| 2-3-4-6-7-9 | (1) | 1-7-9-10 | (1-3) |
| 2-3-4-6-7-9-10 | (1) | 2-3-4-5-6-10 | (1) |
| 2-3-4-6-7-8 | (1) | 2-3-4-5-6-9 | (1) |
| 2-3-4-9 | (1) | 2-3-4-5-6-9-10 | (1) |
| 2-3-4-9-10 | (1) | 2-3-4-5-6-8 | (1) |
| 2-3-4-8 | (1) | 2-3-4-5-6-8-10 | (1) |
| 2-3-4-8-10 | (1) | 2-3-4-5-6-8-9 | (1) |
| 2-3-4-8-9 | (1) | 2-3-4-5-6-8-9-10 | (1) |
| 2-3-4-8-9-10 | (1) | 2-3-4-5-6-7 | (1) |
| 2-3-4-7 | (1) | 2-3-4-5-6-7-10 | (1) |
| 2-3-4-7-10 | (1) | 2-3-4-5-6-7-9 | (1) |
| 2-3-4-7-9 | (1) | 2-3-4-5-6-7-9-10 | (1) |
| 2-3-4-7-9-10 | (1) | 2-3-4-5-6-7-8 | (1) |
| 2-3-4-7-8 | (1) | 2-3-4-5-6-7-8-10 | (1) |
| 2-3-4-7-8-10 | (1) | 2-3-4-5-6-7-8-9 | (1) |
| 2-3-4-7-8-9 | (1) | 2-3-4-5-6-7-8-9-10 | (1) |
| 2-3-4-7-8-9-10 | (1) | 1-7-8 | (1-2) |
| 2-3-4-6 | (1) | 1-7-8-10 | (1-2) |
| 2-3-4-6-10 | (1) | 1-7-8-9 | (1-3) |
| 2-3-4-6-9 | (1) | 1-7-8-9-10 | (1-3) |

-continued

ADDRESS COMPUTATION:

| | | | |
|---|---|---|---|
| 2-3-4-6-9-10 | (1) | 1-6 | (1-3) |
| 2-3-4-6-8 | (1) | 1-6-10 | (1-3) |
| 2-3-4-6-8-10 | (1) | 1-6-9 | (1-3) |
| 2-3-4-6-8-9 | (1) | 1-6-9-10 | (1-3) |
| 2-3-4-5-7-8 | (1) | 1-6-8 | (1-3) |
| 2-3-4-5-7-8-10 | (1) | 1-6-8-10 | (1-3) |
| 2-3-4-5-7-8-9 | (1) | 1-6-8-9 | (1-3) |
| 2-3-4-5-7-8-9-10 | (1) | 1-6-8-9-10 | (1-3) |
| 2-3-4-5-6 | (1) | 1-6-7 | (1-3) |
| 2-3-4-6-7-8 | (1) | 1-6-7-10 | (1-3) |
| 2-3-4-6-7-8-9-10 | (1) | 1-6-7-9 | (1-3) |
| 2-3-4-5 | (1) | 1-6-7-9-10 | (1-3) |
| 2-3-4-5-10 | (1) | 1-6-7-8 | (1-2) |
| 2-3-4-5-9 | (1) | 1-6-7-8-10 | (1-3) |
| 2-3-4-5-9-10 | (1) | 1-6-7-8-9 | (1-3) |
| 2-3-4-5-8-10 | (1) | 1-6-7-8-9 | (1-3) |
| 2-3-4-5-9-10 | (1) | 1-6-7-8-9 | (1-3) |
| 2-3-4-5-8 | (1) | 1-6-7-8-9-10 | (1-3) |
| 2-3-4-5-8-10 | (1) | 1-5 | (1) |
| 2-3-4-5-8-9 | (1) | 1-5-10 | (1) |
| 2-3-4-5-8-9-10 | (1) | 1-5-9 | (1) |
| 1-5-9-10 | (1) | 1-4-6-7-10 | (1-3) |
| 1-5-8 | (1) | 1-4-6-7-9 | (1-3) |
| 1-5-8-9 | (1) | 1-4-6-7-9-10 | (1-3) |
| 1-5-8-10 | (1) | 1-4-6-7-8 | (1-2) |
| 1-5-8-9-10 | (1) | 1-4-6-7-8-10 | (1-3) |
| 1-5-7 | (1-3) | 1-4-6-7-8-9 | (1-3) |
| 1-5-7-10 | (1) | 1-4-6-7-8-9-10 | (1-3) |
| 1-5-7-9 | (1) | 1-4-5 | (1) |
| 1-5-7-9-10 | (1) | 1-4-5-10 | (1) |
| 1-5-7-8 | (1) | 1-4-5-9 | (1) |
| 1-4-7-8-10 | (1) | 1-4-5-9-10 | (1) |
| 1-5-7-8-9 | (1) | 1-4-5-8 | (1) |
| 1-5-7-8-9-10 | (1) | 1-4-5-8-10 | (1) |
| 1-5-6 | (1-3) | 1-4-5-8-9 | (1) |
| 1-5-6-10 | (1-3) | 1-4-5-8-9-10 | (1) |
| 1-5-6-9 | (1-3) | 1-4-5-7 | (1) |
| 1-5-6-9-10 | (1-3) | 1-4-5-7-10 | (1) |
| 1-5-6-8 | (1-3) | 1-4-5-7-9 | (1) |
| 1-5-6-8-10 | (1-3) | 1-4-5-7-9-10 | (1) |
| 1-5-6-8-9 | (1-3) | 1-4-5-7-8 | (1) |
| 1-5-6-8-9-10 | (1-3) | 1-4-5-7-8-10 | (1) |
| 1-5-6-7 | (1-3) | 1-4-5-7-8-9 | (1) |
| 1-5-6-7-9 | (1-3) | 1-4-5-6 | (1-3) |
| 1-5-6-7-9-10 | (1-3) | 1-4-5-6-10 | (1-3) |
| 1-5-6-7-8 | (1-3) | 1-4-5-6-9 | (1-3) |
| 1-5-6-7-8-10 | (1-3) | 1-4-5-6-9-10 | (1-3) |
| 1-5-6-7-8-9 | (1-3) | 1-4-5-6-8 | (1-3) |
| 1-5-6-7-8-9-10 | (1-3) | 1-4-5-6-8-10 | (1-3) |
| 1-4 | (1-2) | 1-4-5-6-8-9 | (1-3) |
| 1-4-10 | (1-2) | 1-4-5-6-8-9-10 | (1-3) |
| 1-4-9 | (1-3) | 1-4-5-6-7 | (1-3) |
| 1-4-9-10 | (1-2) | 1-4-5-6-7-10 | (1-3) |
| 1-4-8 | (1-2) | 1-4-5-6-7-9 | (1-3) |
| 1-4-8-10 | (1-2) | 1-4-5-6-7-9-10 | (1-3) |
| 1-4-8-9 | (1-2) | 1-4-5-6-7-8 | (1-3) |
| 1-4-8-9-10 | (1-2) | 1-4-5-6-7-8-10 | (1-3) |
| 1-4-7 | (1-2) | 1-4-5-6-7-8-9 | (1-3) |
| 1-4-7-10 | (1-2) | 1-4-5-6-7-8-9-10 | (1-3) |
| 1-4-7-9 | (1-3) | 1-3 | (1-3) |
| 1-4-7-9-10 | (1-2) | 1-3-10 | (1-3) |
| 1-4-7-8 | (1-2) | 1-3-9 | (1-3) |
| 1-4-7-8-10 | (1-2) | 1-3-9-10 | (1-3) |
| 1-4-7-8-9 | (1-2) | 1-3-8 | (1) |
| 1-4-7-8-9-10 | (1-2) | 1-3-8-10 | (1-2) |
| 1-4-6 | (1-3) | 1-3-8-9 | (1-3) |
| 1-4-6-10 | (1-3) | 1-3-8-9-10 | (1-3) |
| 1-4-6-9 | (1-3) | 1-3-7 | (1-3) |
| 1-4-6-9-10 | (1-3) | 1-3-7-10 | (1-3) |
| 1-4-6-8 | (1-2) | 1-3-7-9 | (1-3) |
| 1-4-6-8-10 | (1-3) | 1-3-7-9-10 | (1-3) |
| 1-4-6-8-9 | (1-3) | 1-3-7-8 | (1-2) |
| 1-4-6-8-9-10 | (1-3) | 1-3-7-8-10 | (1-3) |
| 1-4-6-7 | (1-2) | 1-3-7-8-9 | (1-3) |
| 1-3-7-8-9-10 | (1-3) | 1-3-4-8-9 | (1-3) |
| 1-3-6 | (1-3) | 1-3-4-8-9-10 | (1-3) |
| 1-3-6-10 | (1-3) | 1-3-4-7 | (1-2) |
| 1-3-6-9 | (1-3) | 1-3-4-7-10 | (1-2) |
| 1-3-6-9-10 | (1-3) | 1-3-4-7-9 | (1-3) |
| 1-3-6-8 | (1-2) | 1-3-4-7-9-10 | (1-3) |
| 1-3-6-8-10 | (1-2) | 1-3-4-7-8 | (1-2) |

-continued

ADDRESS COMPUTATION:

| | | | |
|---|---|---|---|
| 1-3-6-8-9 | (1-3) | 1-3-4-7-8-10 | (1-2) |
| 1-3-6-8-9-10 | (1-3) | 1-3-4-7-8-9 | (1-2) |
| 1-3-6-7 | (1-3) | 1-3-4-7-8-9-10 | (1-3) |
| 1-3-6-7-10 | (1-3) | 1-3-4-6 | (1-3) |
| 1-3-6-7-9 | (1-3) | 1-3-4-6-10 | (1-3) |
| 1-3-6-7-9-10 | (1-3) | 1-3-4-6-9 | (1-3) |
| 1-3-6-7-8 | (1-2) | 1-3-4-6-9-10 | (1-3) |
| 1-3-6-7-8-10 | (1-2) | 1-3-4-6-8 | (1-2) |
| 1-3-6-7-8-9 | (1-3) | 1-3-4-6-8-10 | (1-2) |
| 1-3-6-7-8-9-10 | (1-3) | 1-3-4-6-8-9 | (1-3) |
| 1-3-5 | (1-3) | 1-3-4-6-8-9-10 | (1-3) |
| 1-3-5-10 | (1-3) | 1-3-4-6-7 | (1-2) |
| 1-3-5-9 | (1-3) | 1-3-4-6-7-10 | (1-3) |
| 1-3-5-9 | (1-3) | 1-3-4-6-7-9 | (1-3) |
| 1-3-5-8 | (1-3) | 1-3-4-6-7-9-10 | (1-3) |
| 1-3-5-8-10 | (1-3) | 1-3-4-6-7-8 | (1-2) |
| 1-3-5-8-9 | (1-3) | 1-3-4-6-7-8-10 | (1-2) |
| 1-3-5-8-9-10 | (1-3) | 1-3-4-6-7-8-9 | (1-3) |
| 1-3-5-7 | (1-3) | 1-3-4-6-7-8-9-10 | (1-3) |
| 1-3-5-7-10 | (1-3) | 1-3-4-5 | (1-3) |
| 1-3-5-7-9 | (1-3) | 1-3-4-5-10 | (1-3) |
| 1-3-5-7-9-10 | (1-3) | 1-3-4-5-9 | (1-3) |
| 1-3-5-7-8 | (1-3) | 1-3-4-5-9-10 | (1-3) |
| 1-3-5-7-8-10 | (1-3) | 1-3-4-5-8 | (1-3) |
| 1-3-5-7-8-9 | (1-3) | 1-3-4-5-8-10 | (1-3) |
| 1-3-5-6 | (1-3) | 1-3-4-5-8-9-10 | (1-3) |
| 1-3-5-6-10 | (1-3) | 1-3-4-5-7 | (1-3) |
| 1-3-5-6-9 | (1-3) | 1-3-4-5-7-10 | (1-3) |
| 1-3-5-6-9-10 | (1-3) | 1-3-4-5-7-9 | (1-3) |
| 1-3-5-6-8 | (1-3) | 1-3-4-5-7-9-10 | (1-3) |
| 1-3-5-6-8-10 | (1-3) | 1-3-4-5-7-8 | (1-3) |
| 1-3-5-6-8-9 | (1-3) | 1-3-4-5-7-8-10 | (1-3) |
| 1-3-5-6-8-9-10 | (1-3) | 1-3-4-5-7-8-9 | (1-3) |
| 1-3-5-6-7 | (1-3) | 1-3-4-5-7-8-9-10 | (1-3) |
| 1-3-5-6-7-10 | (1-3) | 1-3-4-5-6 | (1-3) |
| 1-3-5-6-7-9 | (1-3) | 1-3-4-5-6-10 | (1-3) |
| 1-3-5-6-7-9-10 | (1-3) | 1-3-4-5-6-9 | (1-3) |
| 1-3-5-6-7-8 | (1-3) | 1-3-4-5-6-9-10 | (1-3) |
| 1-3-5-6-7-8-10 | (1-3) | 1-3-4-5-6-8 | (1-3) |
| 1-3-5-6-7-8-9 | (1-3) | 1-3-4-5-6-8-10 | (1-3) |
| 1-3-5-6-7-8-9-10 | (1-3) | 1-3-4-5-6-8-9 | (1-3) |
| 1-3-4 | (1-2) | 1-3-4-5-6-8-9-10 | (1-3) |
| 1-3-4-10 | (1-2) | 1-3-4-5-6-7 | (1-3) |
| 1-3-4-9 | (1-3) | 1-3-4-5-6-7-10 | (1-3) |
| 1-3-4-9-10 | (1-3) | 1-3-4-5-6-7-9 | (1-3) |
| 1-3-4-8 | (1-2) | 1-3-4-5-6-7-9-10 | (1-3) |
| 1-3-4-8-10 | (1-2) | 1-3-4-5-6-7-8 | (1-3) |
| 1-3-4-5-6-7-8-10 | (1-3) | 1-2-5-6-9-10 | (1-3) |
| 1-3-4-5-6-7-8-9 | (1-3) | 1-2-5-6-8 | (1-3) |
| 1-3-4-5-6-7-8-9-10 | (1-3) | 1-2-5-6-8-10 | (1-3) |
| 1-2 | (1-2) | 1-2-5-6-8-9 | (1-3) |
| 1-2-10 | (1-2) | 1-2-5-6-8-9-10 | (1-3) |
| 1-2-9 | (1-3) | 1-2-5-6-7 | (1-3) |
| 1-2-9-10 | (1-2) | 1-2-5-6-7-10 | (1-3) |
| 1-2-8 | (1) | 1-2-5-6-7-9 | (1-3) |
| 1-2-8-10 | (1-2) | 1-2-5-6-7-9-10 | (1-3) |
| 1-2-8-9 | (1) | 1-2-5-6-7-8 | (1-3) |
| 1-2-8-9-10 | (1-2) | 1-2-5-6-7-8-10 | (1-3) |
| 1-2-7 | (1-2) | 1-2-5-6-7-8-9 | (1-3) |
| 1-2-7-10 | (1-2) | 1-2-5-6-7-8-9-10 | (1-3) |
| 1-2-7-9 | (1-3) | 1-2-4 | (1-2) |
| 1-2-7-9-10 | (1) | 1-2-4-10 | (1-2) |
| 1-2-7-8 | (1-2) | 1-2-4-9 | (1-3) |
| 1-2-7-8-10 | (1-2) | 1-2-4-9-10 | (1) |
| 1-2-7-8-9 | (1) | 1-2-4-8 | (1-2) |
| 1-2-7-8-9-10 | (1) | 1-2-4-8-10 | (1-2) |
| 1-2-6 | (1-3) | 1-2-4-8-9 | (1) |
| 1-2-6-10 | (1-3) | 1-2-4-8-9-10 | (1) |
| 1-2-6-9 | (1-3) | 1-2-4-7 | (1-2) |
| 1-2-6-9-10 | (1-3) | 1-2-4-7-10 | (1-2) |
| 1-2-6-8 | (1-2) | 1-2-4-7-9 | (1-3) |
| 1-2-6-8-10 | (1-2) | 1-2-4-7-9-10 | (1) |
| 1-2-6-8-9 | (1-2) | 1-2-4-7-8 | (1-2) |
| 1-2-6-8-9-10 | (1-2) | 1-2-4-7-8-9 | (1) |
| 1-2-6-7 | (1-2) | 1-2-4-7-8-10 | (1-2) |
| 1-2-6-7-10 | (1-3) | 1-2-4-7-8-9-10 | (1) |
| 1-2-6-7-9 | (1-3) | 1-2-4-6 | (1-2) |
| 1-2-6-7-9-10 | (1-3) | 1-2-4-6-10 | (1-3) |
| 1-2-6-7-8 | (1-2) | 1-2-4-6-9 | (1-3) |
| 1-2-6-7-8-10 | (1-2) | 1-2-4-6-9-10 | (1-3) |
| 1-2-6-7-8-9 | (1) | 1-2-4-6-8 | (1-2) |

-continued

ADDRESS COMPUTATION:

| | | | |
|---|---|---|---|
| 1-2-6-7-8-9-10 | (1) | 1-2-4-6-8-10 | (1-2) |
| 1-2-5 | (1) | 1-2-4-6-8-9 | (1-3) |
| 1-2-5-10 | (1-2) | 1-2-4-6-8-9-10 | (1-3) |
| 1-2-5-9 | (1) | 1-2-4-6-7 | (1-2) |
| 1-2-5-9-10 | (1-2) | 1-2-4-6-7-10 | (1-3) |
| 1-2-5-8 | (1) | 1-2-4-6-7-8 | (1-3) |
| 1-2-5-8-10 | (1-2) | 1-2-4-6-7-9-10 | (1-3) |
| 1-2-5-8-9 | (1) | 1-2-4-6-7-8 | (1-2) |
| 1-2-5-8-9-10 | (1-2) | 1-2-4-6-7-8-0 | (1-2) |
| 1-2-5-7 | (1) | 1-2-4-6-7-8-9 | (1-3) |
| 1-2-5-7-10 | (1-2) | 1-2-4-6-7-8-9-10 | (1-3) |
| 1-2-5-7-9 | (1) | 1-2-4-5 | (1) |
| 1-2-5-7-9-10 | (1) | 1-2-4-5-10 | (1-2) |
| 1-2-5-7-8 | (1) | 1-2-4-5-9 | (1) |
| 1-2-5-7-8-10 | (1-2) | 1-2-4-5-9-10 | (1) |
| 1-2-5-7-8-9 | (1) | 1-2-4-5-8 | (1) |
| 1-2-5-7-8-9-10 | (1) | 1-2-4-5-8-10 | (1-2) |
| 1-2-5-6 | (1-3) | 1-2-4-5-8-9 | (1) |
| 1-2-5-6-10 | (1-3) | 1-2-4-5-8-9-10 | (1) |
| 1-2-5-6-9 | (1-3) | 1-2-4-5-7 | (1) |
| 1-2-4-5-7-10 | (1-2) | 1-2-3-5 | (1-3) |
| 1-2-4-5-7-9 | (1) | 1-2-3-5-10 | (1-3) |
| 1-2-4-5-7-9-10 | (1) | 1-2-3-5-9- | (1-3) |
| 1-2-4-5-7-8 | (1) | 1-2-3-5-9-10 | (1-3) |
| 1-2-4-5-7-8-9 | (1) | 1-2-3-5-8- | (1-3) |
| 1-2-4-5-7-8-10 | (1-2) | 1-2-3-5-8-10 | (1-3) |
| 1-2-4-5-7-8-9-10 | (1) | 1-2-3-5-8-9 | (1-3) |
| 1-2-4-5-6 | (1-3) | 1-2-3-5-8-9-10 | (1-3) |
| 1-2-4-5-6-10 | (1-3) | 1-2-3-5-7 | (1-3) |
| 1-2-4-5-6-9 | (1-3) | 1-2-3-5-7-10 | (1-3) |
| 1-2-4-5-6-9-10 | (1-3) | 1-2-3-5-7-9 | (1-3) |
| 1-2-4-5-6-8 | (1-3) | 1-2-3-5-7-9-10 | (1-3) |
| 1-2-4-5-6-8-10 | (1-3) | 1-2-3-5-7-8 | (1-3) |
| 1-2-4-5-6-8-9 | (1-3) | 1-2-3-5-7-8-10 | (1-3) |
| 1-2-4-5-6-8-9-10 | (1-3) | 1-2-3-5-7-8-9 | (1-3) |
| 1-2-4-5-6-7 | (1-3) | 1-2-3-5-7-8-9-10 | (1-3) |
| 1-2-4-5-6-7-10 | (1-3) | 1-2-3-5-6 | (1-3) |
| 1-2-4-5-6-7-9 | (1-3) | 1-2-3-5-6-10 | (1-3) |
| 1-2-4-5-6-7-9-10 | (1-3) | 1-2-3-5-6-9 | (1-3) |
| 1-2-4-5-6-7-8 | (1-3) | 1-2-3-5-6-9-10 | (1-3) |
| 1-2-4-5-6-7-8-10 | (1-3) | 1-2-3-5-6-8 | (1-3) |
| 1-2-4-5-6-7-8-9 | (1-3) | 1-2-3-5-6-8-10 | (1-3) |
| 1-2-4-5-6-7-8-9-10 | (1-3) | 1-2-3-5-6-8-9 | (1-3) |
| 1-2-3 | (1-3) | 1-2-3-5-6-8-9-10 | (1-3) |
| 1-2-3-10 | (1-3) | 1-2-3-5-6-7 | (1-3) |
| 1-2-3-9 | (1-3) | 1-2-3-5-6-7-10 | (1-3) |
| 1-2-3-9-10 | (1-3) | 1-2-3-5-6-7-9 | 1-3) |
| 1-2-3-8 | (1) | 1-2-3-5-6-7-9-10 | (1-3) |
| 1-2-3-8-10 | (1-2) | 1-2-3-5-6-7-8 | (1-3) |
| 1-2-3-8-9 | (1-1) | 1-2-3-5-6-7-8-10 | (1-3) |
| 1-2-3-8-9-10 | (1) | 1-2-3-5-6-7-8-9 | (1-3) |
| 1-2-3-7 | (1-2) | 1-2-3-5-6-7-8-9-10 | (1-3) |
| 1-2-3-7-10 | (1-2) | 1-2-3-4 | (1-2) |
| 1-2-3-7-9 | (1-3) | 1-2-3-4-10 | (1-2) |
| 1-2-3-7-9-10 | (1-3) | 1-2-3-4-9 | (1-3) |
| 1-2-3-7-8- | (1-2) | 1-2-3-4-9-10 | (1-3) |
| 1-2-3-7-8-10 | (1-2) | 1-2-3-4-8 | (1-2) |
| 1-2-3-7-8-9 | (1) | 1-2-3-4-8-10 | (1-2) |
| 1-2-3-7-8-9-10 | (1) | 1-2-3-4-8-9 | (1) |
| 1-2-3-6 | (1) | 1-2-3-4-8-9-10 | (1) |
| 1-2-3-6-10 | (1-3) | 1-2-3-4-7 | (1-2) |
| 1-2-3-6-9 | (1-3) | 1-2-3-4-7-10 | (1-2) |
| 1-2-3-6-9-10 | (1-3) | 1-2-3-4-7-9 | (1-3) |
| 1-2-3-6-8 | (1-2) | 1-2-3-4-7-9-10 | (1-3) |
| 1-2-3-6-8-10 | (1-2) | 1-2-3-4-7-8 | (1-3) |
| 1-2-3-6-8-9 | (1) | 1-2-3-4-7-8-10 | (1-2) |
| 1-2-3-6-8-9-10 | (1) | 1-2-3-4-7-8-9 | (1-3) |
| 1-2-3-6-7 | (1-2) | 1-2-3-4-7-8-9-10 | (1-3) |
| 1-2-3-6-7-10 | (1-3) | 1-2-3-4-6 | (1-2) |
| 1-2-3-6-7-9 | (1-3) | 1-2-3-4-6-10 | (1-3) |
| 1-2-3-6-7-9-10 | (1-3) | 1-2-3-4-6-9 | (1-3) |
| 1-2-3-6-7-8 | (1-2) | 1-2-3-4-6-9-10 | (1-3) |
| 1-2-3-6-7-8-10 | (1-2) | 1-2-3-4-6-8 | (1-2) |
| 1-2-3-6-7-8-9 | (1) | 1-2-3-4-6-8-10 | (1-2) |
| 1-2-3-6-7-8-9-10 | (1) | 1-2-3-4-6-8-9 | (1-3) |
| 1-2-3-4-6-8-9-10 | (1-3) | | |
| 1-2-3-4-6-7 | (1-2) | | |
| 1-2-3-4-6-7-10 | (1-3) | | |
| 1-2-3-4-6-7-9 | (1-3) | | |
| 1-2-3-4-6-7-9-10 | (1-3) | | |
| 1-2-3-4-6-7-8 | (1-2) | | |

-continued

| ADDRESS COMPUTATION: | |
|---|---|
| 1-2-3-4-6-7-8-10 | (1-2) |
| 1-2-3-4-6-7-8-9 | (1-3) |
| 1-2-3-4-6-7-8-9-10 | (1-3) |
| 1-2-3-4-5- | (1-3) |
| 1-2-3-4-5-10 | (1-3) |
| 1-2-3-4-5-9 | (1-3) |
| 1-2-3-4-5-9-10 | (1-3) |
| 1-2-3-4-5-8 | (1-3) |
| 1-2-3-4-5-8-10 | (1-3) |
| 1-2-3-4-8-9 | (1-3) |
| 1-2-3-4-5-8-9-10 | (1-3) |
| 1-2-3-4-5-7 | (1-3) |
| 1-2-3-4-5-7-10 | (1-3) |
| 1-2-3-4-5-7-9 | (1-3) |
| 1-2-3-4-5-7-9-10 | (1-3) |
| 1-2-3-4-5-7-8 | (1-3) |
| 1-2-3-4-5-7-8-10 | (1-3) |
| 1-2-3-4-5-7-8-9 | (1-3) |
| 1-2-3-4-5-7-8-9-10 | (1-3) |
| 1-2-3-4-5-6 | (1-3) |
| 1-2-3-4-5-6-10 | (1-3) |
| 1-2-3-4-5-6-9 | (1-3) |
| 1-2-3-4-5-6-9-10 | (1-3) |
| 1-2-3-4-5-6-8 | (1-3) |
| 1-2-3-4-5-6-8-10 | (1-3) |
| 1-2-3-4-5-6-8-9 | (1-3) |
| 1-2-3-4-5-6-8-9-10 | (1-3) |
| 1-2-3-4-5-6-7 | (1-3) |
| 1-2-3-4-5-6-7-10 | (1-3) |
| 1-2-3-4-5-6-7-9 | (1-3) |
| 1-2-3-4-5-6-7-9-10 | (1-3) |
| 1-2-3-4-5-6-7-8 | (1-3) |
| 1-2-3-4-5-6-7-10 | (1-3) |
| 1-2-3-4-5-6-7-8-9 | (1-3) |
| 1-2-3-4-5-6-7-8-9-10 | (1-3) |

It is noted further, that a copy of each of the above referenced documents are on file with the Patent and Trademark Office in connection with the disclosure of this application for review of the public upon request.

It should be understood that the BOWLING BALL PATH INDICATOR WITH ROM BALL PATH SELECTOR may be modified as would occur to one of ordinary skill in the art without departing from the spirit and scope of the present invention.

It is claimed:

1. In an optimum ball path indicator means for a bowling alley including a pin spotter, a pin spotter mask having selectively illuminated ball path arrows thereon and pin sensing means responsive to pins left standing after the bowling of a first ball in a bowling frame, the invention comprising:

means for selecting and illuminating an optimum ball path and a ball path arrow corresponding thereto for the bowling of a second ball in said bowling frame comprising:

a plurality of standing pin data input means corresponding one to each standing position on a bowling alley and responsive to the presence and absence of standing pins at said standing pin positions to generate representative first and second logic state signals, respectively;

read only memory means having a plurality of address input means correlated, respectively, with said standing pin data input means and connected therewith to receive standing pin information represented by a combination of said first and second logic state signals with said combination of first and second logic state signals corresponding to a discrete address in said read only memory means;

said read only memory means converting combinations of said first and second logic state signals at said address input means to a coded output peculiar to an optimum ball path for each said combination; and outputs for converting a known group of said coded outputs to a predetermined enabling output for selectively enabling a ball path arrow on said pin spotter mask representing the optimum ball path.

2. The invention defined in claim 1, which includes a power source; and wherein said plurality standing pin data input means comprises:

a data channel representative of each standing pin position and normally connected with said power source to provide an inverted second logic state signal thereon in response to the absence of a pin at a corresponding said standing pin position;

a logic state generating means in each said data channel including impedance means for selective interconnection with said source; and gate controlled switch means in each said data channel and responsive to the presence of a standing pin at a corresponding standing pin position for interconnecting said impedance means with said source to generate an inverted first logic state signal in its corresponding said data channel and remove said inverted second logic state signal therefrom to provide a combination of inverted first and second logic state signals on said data channels representative of a standing pin pattern on said standing pin positions; and inverter/driver means connected with said plurality of data channels for receiving said combination of inverted first and second logic state signals, inverting said signals to form said combination of first and second logic state signals representative of said standing pin information and applying the latter to said address input means of said read only memory means.

3. The invention defined in claim 1, which further includes enabling means responsive to a pin clearing and sensing machine cycle of said pin spotter subsequent to the bowling of a first ball in a bowling frame for gating said plurality of pin data input means and said decoding and driving means to respectively transmit and receive information to and from said read only memory means.

4. The invention defined in claim 3, wherein said plurality of pin data input means and said decoding and driving means are both enabled in a finite interval in said machine cycle and said decoding and driving means is enabled subsequent in time to said pin data input means.

5. The invention defined in claim 1, which includes a source of power; and wherein said decoding and driving means comprises:

a decoder demultiplexer for receiving and converting said output code from said read only memory means to an enabling output signal at a peculiar one of a known plurality of enabling outputs corresponding to one of a respective plurality of optimum resolved ball paths;

a plurality of ball path lamp means associated with a corresponding ball path on said pin spotter mask representative of said known plurality of optimum resolved ball paths; and a plurality of gate controlled switch means corresponding one to each ball path lamp means and a corresponding peculiar one of said known plurality of enabling outputs of selectively interconnecting said ball path lamp means with said source of power to illuminate a corresponding ball path arrow to define on said mask an optimum resolved ball path corresponding to the said peculiar one of said known plurality of enabling outputs bearing said enabling output signal.

6. The invention defined in claim 5, wherein said plurality standing pin data input means comprises:

a data channel representative of each standing pin position and normally connected with said power source to provide an inverted second logic state signal thereon in response to the absence of a pin at a corresponding said standing pin position;

a logic state generating means in each said data channel including impedance means for selective interconnection with said source; and gate controlled switch means in each said data channel and responsive to the presence of a standing pin at a corresponding standing pin position for interconnecting said impedance means with said source to generate an inverted first logic state signal in its corresponding said data channel and remove said inverted second logic state signal therefrom to provide a combination of inverted first and second logic state signals on said data channels representative of a standing pin pattern on said standing pin positions; and inverter/driver means connected with said plurality of data channels for receiving said combination of inverted first and second logic state signals, inverting said signals to form said combination of first and second logic state signals representative of said standing pin information and applying the latter to said address input means of said read only memory means.

7. The invention defined in claim 6, which further includes enabling means responsive to a pin clearing and sensing machine cycle of said pin spotter subsequent to the bowling of a first ball in a bowling frame for gating said plurality of pin data input means and said decoding and driving means to respectively transmit and receive information to and from said read only memory means.

8. The invention defined in claim 7, wherein said plurality of pin data input means and said decoding and driving means are both enabled in a finite interval in said machine cycle and said decoding and driving means is enabled subsequent in time to said pin data input means.

9. The invention defined in either of claims 3 or 4, which includes a power source; and wherein said plurality standing pin data input means comprises:

a data channel representative of each standing pin position and normally connected with said power source to provide an inverted second logic state signal thereon in response to the absence of a pin at a corresponding said standing pin position;

a logic state generating means in each said data channel including impedance means for selective interconnection with said source; and gate controlled switch means in each said data channel and responsive to the presence of a standing pin at a corresponding standing pin position for interconnecting said impedance means with said source to generate an inverted first logic state signal in its corresponding said data channel and remove said inverted second logic state signal therefrom to provide a combination of inverted first and second logic state signals on said data channels representative of a standing pin pattern on said standing pin positions; and inverter/driver means connected with said plurality of data channels for receiving said combination of inverted first and second logic state signals, inverting said signals to form said combination of first and second logic state signals representative of said standing pin information and applying the latter to said address input means of said read only memory means.

10. The invention defined in either of claims 3 or 4, which includes a source of power; and wherein said decoding and driving means comprises:

a decoder demultiplexer for receiving and converting said output code from said read only memory means to an enabling output signal at a peculiar one of a known plurality of enabling outputs corresponding to one of a respective plurality of optimum resolved ball paths;

a plurality of ball path lamp means associated with a corresponding ball path on said pin spotter mask representative of said known plurality of optimum resolved ball paths; and a plurality of gate controlled switch means corresponding one to each ball path lamp means and a corresponding peculiar one of said known plurality of enabling outputs of selectively interconnecting said ball path lamp means with said source of power to illuminate a corresponding ball path arrow to define on said mask an optimum resolved ball path corresponding to the said peculiar one of said known plurality of enabling outputs bearing said enabling output signal.

11. The invention defined in either of claims 1, 2, 3, 4 or 5, wherein said pin spotter mask further includes a standing pin spot indicator for each standing pin position; and wherein said invention further comprises:

standing pin indicating lamp means associated with each standing pin spot indicator and responsive to the presence of a standing pin at a given pin spot to illuminate a corresponding one of said standing pin spot indicators.

12. The invention defined in claim 6, wherein said pin spotter mask further includes a standing pin spot indicator for each standing pin position; and wherein said invention further comprises:

standing pin indicating lamp means associated with each standing pin spot indicator and responsive to the presence of a standing pin at a given pin spot to illuminate a corresponding one of said standing pin spot indicators.

13. The invention defined in claim 12, which further includes enabling means responsive to a pin clearing and sensing machine cycle of said pin spotter subsequent to the bowling of a first ball in a bowling frame for gating said plurality of pin data input means and said decoding and driving means to respectively transmit and receive information to and from said read only memory means.

14. The invention defined in claim 13, wherein said plurality of pin data input means and said decoding and driving means are both enabled in a finite interval in said machine cycle and said decoding and driving means is enabled subsequent in time to said pin data input means.

15. Means for determining a predetermined one of a plurality of known optimum resolved ball paths for maximizing pinfall in any one of the entire range of potential combinations of standing pins on the standard standing pin points of a bowling alley, said means comprising:

data means sensing a standing pin pattern and providing first and second logic signals representative of the presence or absence of a standing pin at each of said standing pin points;

a data channel for each standing pin point receiving a corresponding one of said logic state signals from said sensing means to provide a combination of first and second logic state signals thereon;

a read only memory means having a plurality of input address terminals corresponding one to each of said data channels for receiving said combination of first and second logic state signals, with said combination of first and second logic state signals corresponding to a discrete address in said read only memory means;

said read only memory means being responsive to each received combination of said logic state signals to provide a coded output representative thereof; and decoding means having a plurality of enabling outputs corresponding one to each of said plurality of known optimum resolved ball paths;

said decoding means receiving and being responsive to said coded outputs from said read only memory means to generate an enabling signal on the particular one of said enabling outputs corresponding to a predetermined one of said known optimum resolved ball paths peculiar to the standing pin pattern sensed by said data means.

16. In an optimum ball path indicator means for a bowling alley including a pin spotter, a pin spotter mask having selectively displayable ball path indicators thereon and pin sensing means responsive to pins left standing after the bowling of a first ball in a bowling frame, the invention comprising:

means for selectively displaying an optimum ball path for the bowling of a second ball in said bowling frame comprising:

a plurality of standing pin data input means corresponding one to each standing pin position on a bowling alley and responsive to the presence and absence of standing pins at said standing pin positions to generate representative first and second (logic state) signals, respectively;

a self-contained processor means having a plurality of address input means correlated, respectively, with said standing pin data input means and connected therewith to receive standing pin information represented by a combination of said first and second (logic state) signals with each said combination of first and second logic state signals corresponding to a discrete address in said processor means;

said processor means being responsive to said first and second (logic state) signals at said address input means to provide an output coded signal peculiar to each optimum ball path indicator; and decoding and driving means receiving and responsive to said output coded signal for generating a predetermined enabling output for corresponding to known groups of said output coded signals for selectively enabling a ball path indicator on said pin spotter mask representing said optimum ball path.

* * * * *